US006613991B1

(12) United States Patent
Amonett et al.

(10) Patent No.: US 6,613,991 B1
(45) Date of Patent: Sep. 2, 2003

(54) TIMER

(75) Inventors: Daniel Keith Amonett, Murfreesboro, TN (US); Charles F. Malone, Smithville, TN (US)

(73) Assignee: France/Scott Fetzer Company, Fairview, TN (US)

( * ) Notice: Subject to any disclaimer, the term of this patent is extended or adjusted under 35 U.S.C. 154(b) by 0 days.

(21) Appl. No.: 10/000,414

(22) Filed: Nov. 2, 2001

Related U.S. Application Data

(63) Continuation-in-part of application No. 09/368,284, filed on Aug. 3, 1999, which is a continuation-in-part of application No. 09/365,561, filed on Aug. 2, 1999, now Pat. No. 6,080,943.

(51) Int. Cl.[7] ..... H01H 7/08
(52) U.S. Cl. ..... 200/38 F; 200/38 B
(58) Field of Search ..... 200/38 F, 38 R, 200/38 B, 38 C, 38 BA; 310/6 G–6 J, 46, 75 R, 109

(56) References Cited

U.S. PATENT DOCUMENTS

| | | | | |
|---|---|---|---|---|
| 3,204,052 | A | 8/1965 | Wiser et al. | 200/38 |
| 3,306,996 | A | 2/1967 | Simmons et al. | 200/38 |
| 3,342,957 | A | 9/1967 | Burragato et al. | 200/38 |
| 3,390,243 | A | 6/1968 | Obermann | 200/166 |
| 3,431,372 | A | 3/1969 | Obermann | 200/38 |
| 3,500,005 | A | 3/1970 | Brown | 200/38 |
| 3,582,582 | A | 6/1971 | Pauker et al. | 200/38 |
| 3,649,781 | A | 3/1972 | Johnsen et al. | 200/33 B |
| 3,710,045 | A | 1/1973 | Jochim | 200/37 R |
| 3,735,062 | A | 5/1973 | Chestnut et al. | 200/38 R |
| 3,737,595 | A | 6/1973 | Simmons et al. | 200/33 R |
| 3,737,597 | A | 6/1973 | Jones et al. | 200/38 BA |
| 3,738,185 | A | 6/1973 | Wooley | 74/116 |
| 3,742,159 | A | 6/1973 | Brown | 200/38 R |
| 3,780,240 | A | 12/1973 | Stafford et al. | 200/38 R |
| 3,809,831 | A | 5/1974 | Godwin et al. | 200/38 C |
| 3,811,019 | A | 5/1974 | Solari | 200/38 CA |
| 3,846,597 | A | 11/1974 | Ziegler, Jr. | 200/38 BA |
| 3,925,630 | A | 12/1975 | Harris | 200/39 R |
| 3,941,000 | A | 3/1976 | Allison, Jr. | 74/3.5 |
| 4,046,980 | A | 9/1977 | Rosebrock | 200/153 LA |
| 4,074,112 | A | 2/1978 | Runft | 200/279 |
| 4,103,119 | A | 7/1978 | Homan et al. | 200/35 R |
| 4,112,266 | A | 9/1978 | Linn | 200/38 C |
| 4,130,744 | A | 12/1978 | Beecher, II et al. | 200/1 A |
| 4,146,760 | A | 3/1979 | Voland | 200/38 A |
| 4,149,046 | A | 4/1979 | Bolin | 200/38 A |
| 4,153,824 | A | 5/1979 | Blackmond | 200/35 R |

(List continued on next page.)

FOREIGN PATENT DOCUMENTS

| | | | |
|---|---|---|---|
| CA | 2207311 | 11/1997 | G05G/1/08 |
| CA | 2207944 | 10/2000 | G01M/13/00 |
| CA | 2207294 | 2/2001 | G05G/21/00 |
| CA | 2207295 | 5/2001 | G05G/1/00 |
| CN | 1170220 | 5/1996 | H01H/43/00 |
| CN | 1166681 | 5/1997 | H01H/43/00 |
| CN | 1166682 | 5/1997 | H01H/43/10 |
| EP | 0 159 219 | 10/1985 | H01H/43/10 |
| EP | 0 269 143 | 6/1988 | H01H/43/10 |
| FR | 2 622 349 | 4/1989 | H01H/43/10 |

*Primary Examiner*—Elvin Enad
*Assistant Examiner*—Lisa Klaus
(74) *Attorney, Agent, or Firm*—Wood, Herron & Evans, L.L.P.

(57) ABSTRACT

A cam-operated timer includes a rotatable cam-carrying member having cam surfaces thereon, a timing motor, a drive mechanism, a plurality of cam-actuated switches and a switch wafer mounting receiving first and second switch wafers, with one of the wafers including standard switch arms and at least one switch arm of different widths and/or made of different metals.

16 Claims, 19 Drawing Sheets

U.S. PATENT DOCUMENTS

| | | | | |
|---|---|---|---|---|
| 4,246,454 | A | 1/1981 | Ray | 200/38 R |
| 4,307,270 | A | 12/1981 | Smock | 200/38 R |
| 4,348,560 | A | 9/1982 | Ray et al. | 200/38 A |
| 4,355,217 | A | 10/1982 | Cushing | 200/38 R |
| 4,412,110 | A | 10/1983 | Wojtanek | 200/38 R |
| 4,413,164 | A | 11/1983 | Obermann et al. | 200/38 R |
| 4,485,281 | A | 11/1984 | Voland et al. | 200/38 R |
| 4,490,589 | A | 12/1984 | Voland | 200/38 R |
| 4,491,710 | A | 1/1985 | Smock | 200/303 |
| 4,497,985 | A | 2/1985 | Courter et al. | 200/38 R |
| 4,497,986 | A | 2/1985 | Zink et al. | 200/38 R |
| 4,517,426 | A | 5/1985 | Edwards et al. | 200/38 A |
| 4,560,846 | A | 12/1985 | Klopp et al. | 200/38 R |
| 4,626,635 | A | 12/1986 | Mahon | 200/38 A |
| 4,649,239 | A | 3/1987 | Duve | 200/38 R |
| 4,695,683 | A | 9/1987 | Wingler et al. | 200/38 R |
| 4,755,635 | A | 7/1988 | Willigman | 200/35 R |
| 4,796,484 | A | 1/1989 | Eder | 74/568 T |
| 4,827,460 | A | 5/1989 | Mahon et al. | 368/113 |
| 4,856,096 | A | 8/1989 | Mahon et al. | 200/38 C |
| 4,867,005 | A | 9/1989 | Voland | 74/568 T |
| 4,892,982 | A | 1/1990 | Hueber et al. | 200/38 R |
| 4,892,983 | A | 1/1990 | Bogda et al. | 200/38 R |
| 4,948,928 | A | 8/1990 | Willigman | 200/38 R |
| 4,983,790 | A | 1/1991 | Bogda et al. | 200/30 R |
| 5,030,801 | A | 7/1991 | Amonett | 200/38 R |
| 5,113,124 | A | 5/1992 | Hamilton | 318/578 |
| 5,170,022 | A | 12/1992 | Bouron | 200/38 R |
| 5,290,978 | A | 3/1994 | Georgacakis et al. | 200/38 R |
| 5,329,119 | A | 7/1994 | Swartz et al. | 250/229 |
| 5,400,302 | A | 3/1995 | Yamamoto et al. | 368/107 |
| 5,510,585 | A | 4/1996 | Duve et al. | 200/35 R |
| 5,652,418 | A | 7/1997 | Amonett | 200/38 R |
| 5,652,419 | A | 7/1997 | Amonett et al. | 200/38 R |
| 5,684,281 | A | 11/1997 | Amonett | 200/38 R |
| 5,689,096 | A | 11/1997 | Weaver et al. | 200/38 R |
| 5,736,699 | A | 4/1998 | Furlan et al. | 200/38 R |
| 5,739,490 | A | 4/1998 | Amonett et al. | 200/38 B |
| 5,750,948 | A | 5/1998 | Amonett et al. | 200/38 R |
| 5,780,791 | A | 7/1998 | Cole | 200/38 R |
| 5,811,746 | A | 9/1998 | Noritake | 200/38 R |
| 5,828,019 | A | 10/1998 | Joyce | 200/38 B |
| 5,831,230 | A | 11/1998 | Cole | 200/38 R |
| 5,834,718 | A | 11/1998 | Amonett | 200/38 R |
| 5,929,403 | A | 7/1999 | Amonett et al. | 200/38 B |
| 5,949,038 | A | 9/1999 | Amonett | 200/38 B |
| 5,990,426 | A | 11/1999 | Amonett | 200/38 R |
| 6,080,943 | A | 6/2000 | Amonett et al. | 200/38 B |

TIMER

CROSS-REFERENCE TO RELATED APPLICATIONS

This application is a continuation-in-part of U.S. patent application Ser. No. 09/368,284 filed Aug. 3, 1999 by Daniel K. Amonett et al., which is a continuation-in-part of U.S. patent application Ser. No. 09/365,561 filed Aug. 2, 1999 by Daniel K. Amonett et al., now U.S. Pat. No. 6,080,943. Both U.S. Pat. No. 6,080,943 and application Ser. No. 09/368,284 are hereby incorporated by reference herein in their entireties.

FIELD OF THE INVENTION

The present invention relates to cam-operated timers for appliances.

BACKGROUND OF THE INVENTION

Many household appliances are equipped with mechanical timers to control their operation. Examples include dishwashers, icemakers, clotheswashers and dryers, wall and outlet timers, microwave ovens, and various other appliances.

While there is thus a diverse variety of applications for timers, most timers have a similar general structure. Typically, the timer includes a wheel or drum outfitted with cam surfaces. Spring metal switch arms are mounted to ride on these cam surfaces to be raised and lowered from the wheel or drum surface in response to the elevation of the cam surfaces.

A timing motor is typically coupled to rotate the cam wheel or drum, such that the switch arms are raised or lowered in accordance with a predefined regular pattern that is defined by the elevation of the cam surfaces on the wheel or drum. In some timers, the timing motor moves the wheel or drum by causing drive pawls to oscillate and move the cam wheel or drum forward in a step-by-step fashion. In other timers, the timing motor is connected through a gear train to a toothed surface on the cam wheel or drum to rotate the cam wheel or drum in a continuous manner. In either case, the timing motor and its stator, rotor and windings is typically a separately assembled part, housed in a separate housing from the drive assembly; as a consequence, the combination of the timing motor and gear train are fairly substantial in size, and form a large part of the volume and weight of the timer.

The switch arms inside the timer are typically mounted in pairs such that cam-actuated motion of either or both switch arms of a pair causes the pair of arms to make or break and electrical contact therebetween. The switch arms thus form an electrical switch that controls the operation of the appliance. In some timers, switch arms are mounted in groups of three so as to form a single pole, double throw switch or other more complex switching arrangement.

The contacting surfaces of the arms are often coated with expensive metals such as silver alloy to facilitate good contact between the arms and minimize the effects of corrosion. To further facilitate contact between the arms, in some timers a contact rivet is included on each arm, extending toward the opposite arm, such that contact is made between the rivets on the switch arms. To avoid the cost of making and assembling this additional contact rivet, in other timers the arms are stamped with a "dimple", i.e., a raised section of metal that extends toward the opposite arm to form a contact surface. This approach is useful in containing costs where it can be applied; however, where the switch arms are mounted in a group of three, the central switch arm cannot be dimpled to form a contact, since the dimple can only extend in one direction relative to the surface of the central switch arm and the central switch arm must make contact with the arms above and below it. Accordingly, when three switch arms are stacked in this manner, the central switch arm must be outfitted with a contact rivet in order to have surfaces that extend toward both neighboring arms, increasing costs.

In a typical timer there are multiple switches and thus multiple groups of two or more switch arms that interact with the cam surfaces on the cam wheel or drum. In such timers, often the switch arms are mounted in "wafers"; that is, the respective upper arms of each switch is mounted in a first wafer, and the respective lower switch arms of each switch is mounted in a second wafer. The wafers are typically formed of plastic molded over the ends of the switch arms opposite their cam-actuated surfaces. To mount the switch arms for actuation by the cams of the wheel or drum, the wafers are stacked atop each other, and affixed to the timer housing, so that the arms are suspended in a specific position relative to the wheel or drum of the timer.

To assure proper switch functions, the position of the switch arms relative to the wheel or drum, must be controlled to fairly tight tolerances. This means that the size of the wafers, and the position of the switch arms in the wafers, and the mountings to which the switch wafers are mounted, must also be controlled to tight tolerances. Unfortunately, where two or three wafers are stacked to create switch groups of two or three arms, the necessary tolerances become difficult to satisfy, most particularly because it is difficult to maintain a tight tolerance in the switch mounting surfaces that span a long distance, e.g., the entire height of a stack of three wafers. Manufacturing wafers and mountings to sufficiently tight tolerances is thus difficult and expensive.

The switch arms in a wafer are typically made of the same material. Inexpensive metals such as alloy brass are typically used to make switch arms for low current applications. In higher current applications, more expensive, more highly conductive metals such as copper alloy are used to minimize resistance and the resultant heat and energy loss. Unfortunately, even if only one pair of switch arms carries high current, the need for more expensive metals in the switch arms substantially increases the cost of the timer.

The terminal ends of the switch arms are operatively connected to various components of an appliance such as a dryer, in order to control the function of that particular component. Individual leads for each of the electrical components are provided by these terminals and each individually fit to one or more of wafers forming part of a switch block made up of the stacked wafers and switch arms. The labor involved in connecting individual connectors to individual terminals is relatively intensive. Further the use of separate individual connectors increases the likeliness of incorrect wiring of the switch into the appliance. Additionally, one may appreciate that the individual fitting of each lead to a terminal is time consuming.

The appliance operator typically sets the timer using a knob that extends outside of the timer housing and can be grasped by the operator. In a typical clotheswasher timer, for example, the operator rotates the knob in a forward direction, thereby rotating the cam wheel or drum in a forward direction, until the cam wheel or drum is an appropriate initial position to begin a timed operation cycle.

The user then presses a button, or moves the knob axially to initiate the cycle and also start the timing motor.

As is familiar to most users of household appliances, a substantial clatter is generated by the interaction of the cam-operated switches and drive pawls and/or any one-way or ratchet clutch when the timer is advanced to the appropriate position to begin a cycle. For example, the drive pawls click across the pawl-driven surfaces of the cam wheel or drum as the wheel or drum is advanced, and at the same time, the cam operated switch arms click as they are opened and closed by the cam surfaces as the wheel or drum is rotated, and any one-way clutch also clicks. The resulting noise is unpleasant, and is accompanied by substantial irregular tactile feedback.

A second difficulty is that the timer must be set by rotation in a single direction. This constraint arises from the fact that the cam surfaces on the drum or wheel typically are formed with sharp drop-offs so that switches are closed or opened rapidly. Reverse rotation of the cam will cause the cam surfaces on the drum or wheel to bind against the switch arms, preventing further reverse rotation and potentially damaging the timer. To prevent damage by reverse rotation timers often include a rachet pawl or other mechanism to block reverse rotation; of course, this structure only enhances the clatter generated during forward rotation of the timer for setting.

Recently, so-called "quiet set" drum-type timers have been introduced. In these timers, a mechanism lifts the switch arms and drive pawls from the surface the drum to disengage the drum from the pawls during setting. This permits the drum to be rotated manually without clatter from the pawls and switch arms, and also permits bi-directional rotation during setting because the pawls and arms are disengaged from the drum surface.

Unfortunately, users have become accustomed to receiving tactile feedback when setting a timer, and may prefer to receive such feedback. A "quiet set" timer, therefore, may be perceived as undesirable as compared to a timer that does provide tactile and audible feedback such as a prior non-"quiet set" timer.

Additionally, timers, timer functions, and methods for settings and using timers often varies from appliance to appliance. Such differences result in timers which are not user friendly especially for those appliances which are used in concert with one another, such as clotheswashers and dryers. Thus, it would be desirable to include timers on appliances in a manner more friendly to the user.

SUMMARY OF THE INVENTION

In accordance with the present invention, the drawbacks and difficulties with known cam-operated timers are overcome. In one aspect, the present invention does this by providing electromechanical timers for various appliances that are nearly identical from the user standpoint. For example, the timer of the present invention may be provided on both a clotheswasher and a dryer in order to facilitate ease of operation between those appliances. Additionally, the concept of equivalent, or matched, timers on a clotheswasher and a dryer is of advantage to those who market such appliances. The matched timers increases the likelihood that a customer who purchases one of the appliances, for example the clotheswasher, will purchase the other (the dryer).

Each timer is set in the same or similar manner and the washing or drying action are both started in the same or a similar manner. In the washer a knob attached to a shaft in the timer which is indexed inwardly in order for the shaft to engage a cam-carrying member. The knob can then be rotated to cooperatively rotate the shaft and cam-carrying member to set the washer to a particular cycle. The knob may then be indexed outwardly in order to start the timer and cycle mechanism of the washing machine. The timer provided on the dryer may operate in a manner identical to that of the timer provided on the clotheswasher. The timer on the dryer may also include alternate methods of operation. A first alternate embodiment adds an additional separate start switch which must be actuated to start the dryer. In a second alternate embodiment, the knob traverses a slightly longer distance when indexed outwardly and is held for a period of time in order to start the dryer. In this second alternate embodiment, when released, the knob returns to its original position. Axial movement of the knob and shaft in the opposite direction than that described above is also possible in yet an alternate embodiment. Other combinations of operation of the timer of the present invention are possible depending on the method by which the user turns off the machine or permits the machine to automatically turn off. The timer may also include various combinations of model specific touch, including quiet set features, textured feel features, and a connector with both heavy duty and standard duty terminals. Such features will be described below.

In a first aspect, the invention features a cam-operated timer having a setting feedback function. The timer includes an audible and/or tactile feedback member that is not part of the drive mechanism nor part of the cam-actuated switches of the timer (but may include parts of the cam-carrying member). The audible and/or tactile feedback member is positioned within the timer to engage a textured surface that rotates with or in response to rotation of the timer's cam-carrying member (e.g., the timer's cam wheel or drum), so that upon rotation of the cam-carrying member, the audible and/or tactile feedback member produces desired audible and/or tactile feedback.

In the disclosed specific embodiment, the audible and/or tactile feedback member is a shaped spring member, e.g., a "V"-shaped or "U"-shaped member, which engages to a textured surface comprising a series of ridges or teeth. The textured surface may be carried on the cam-carrying member itself, and the audible and/or tactile feedback member is mounted to the housing so as to engage the textured surface of the cam-carrying member at all times. In other contemplated embodiments, the audible and/or tactile feedback member may be engaged to other members that rotate with the cam-carrying member, rather than to the cam-carrying member itself. Furthermore, the audible and/or tactile feedback member need not always engage to the associated textured surface, but may only engage the associated textured surface when an operator places the timer in a manual setting mode (by, e.g., axially displacing a shaft that serves as the axis of rotation for the cam-carrying member).

In the disclosed specific embodiment, the timer further includes an actuator for engaging the cam-actuated switches and moving the cam-actuated switches away from the cam surfaces of the cam-carrying member when the operator places the timer in a manual setting mode. Further, a clutch is included in the drive mechanism for permitting slip in the drive train between the timing motor and cam-carrying member when the operator places the timer in a manual setting mode. When these elements are utilized, the sole source of audible and/or tactile feedback to the operator when manually setting the timer is the audible and/or tactile feedback member, so that the "feel" of the timer during setting can be tightly controlled and customized. In particular, different models of an appliance line can be distinguished by the audible and/or tactile feel provided by the timer during manual setting. A timer used in the top of the line appliance model can be provided with a feel that is found to be most desirable to typical customers. Gradations of feel can be provided to different timers on lower end models.

The textured surface of the cam-carrying member, and the surface of the audible and/or tactile feedback member that engages to the textured surface, can be configured in various ways to provide the desired audible and/or tactile feedback. Specifically, the ridges on the textured surface and on the engaging surface of the audible and/or tactile feedback member can be made relatively smooth and rounded, or relatively sharp-edged, to change the audible and/or tactile feedback. Furthermore, the spacing between the ridges or teeth on the audible and/or tactile feedback member can be made wider or narrower, regular or irregular, intermittent or random, to change the audible and/or tactile feedback.

Another aspect of the invention relates to the clutch included in the drive mechanism. As noted above, the clutch permits slip in the drive train between the timing motor and cam-carrying member when the operator places the timer in a manual setting mode. When the timer is in its run mode, the clutch also permits forward rotation of the cam-carrying member independently of the timing motor, but prevents independent reverse rotation of the cam-carrying member.

In the disclosed embodiment, the clutch is in the form of a first rotating member and a second rotating member that are included in the drive train between the timing motor and cam-carrying member. The first and second rotating members each include a plurality of protrusions about their surface. When the first and second rotating members are axially aligned, the protrusions of the first rotating member mesh with the protrusions of the second rotating member so as to engage the second rotating member and force reverse rotation of the second rotating member upon reverse rotation of the first rotating member, but permit slip between the second rotating member and first rotating member upon forward rotation of the first rotating member. When the first and second rotating members are not axially aligned, there is no engagement between the protrusions of the first and second rotating members.

In the specific embodiment that is disclosed, the first and second rotating members are gears in the drive train between the timing motor and cam-carrying member. The first rotating member has a plurality of clutch teeth positioned about an inside periphery thereof, and the second rotating member has a plurality of clutch prongs sized to engage the clutch teeth. The first rotating member is annular and defines an orifice about its axis of symmetry. The second rotating member is placed through the orifice so that the clutch prongs of the second rotating member can be axially aligned with the clutch teeth of the first rotating member.

The clutch prongs are circumferentially spaced so that the prongs do not simultaneously align with the clutch teeth. Specifically, there are m prongs circumferentially spaced about the second rotating member, and n teeth circumferentially spaced about the first rotating member; the prongs and teeth are arranged such that exactly one prong aligns with exactly one tooth every 360/mn degrees of relative rotation of the first and second rotating members. In the disclosed specific embodiment, there are five prongs (m=5) and twenty-four teeth (n=24), so that a prong aligns with a tooth every three degrees of relative rotation of the first and second rotating members. Furthermore, the prongs are spaced so that, from a position where a prong on the second rotating member is aligned with a tooth on the first rotating member, three degrees of relative rotation will bring a prong on approximately the opposite side of the second rotating member into alignment with a tooth on the first rotating member.

A third aspect of the present invention relates to structures of the switch arms in the timer. Specifically, the contacting surfaces of one or several switch arms are lanced, that is, there is a tear in the surface of the switch arm, and adjacent the tear a first portion of the contact surface of the arm is deflected away from the surface of the switch arm in a first direction. This structure provides a sharp contact edge that permits the switch arm to make good contact with adjacent switch arm(s) while reducing the effects of corrosion, without resorting to the use of expensive contact metal coatings.

In the illustrated specific embodiment of the invention, a second portion of the contact surface adjacent to the tear in the switch arm, extends away from the surface of the switch arm in a second direction opposite to the first direction. Thus, there are two lanced portions in the contact area of the switch arm extending in opposite directions, so that a switch arm mounted between two other switch arms will have extending portions suitable for making contact with both other switch arms.

A fourth aspect of the present invention relates to the mounting of the switch arms to the timer housing. The housing includes first and second locating areas for receiving first and second switch arm wafers. A first switch arm wafer is mounted to the housing and rests against the first locating area, and a second switch arm wafer is stacked atop the first switch arm wafer and rests against the second locating area. In this manner, the variation in the position of each switch arm wafer is reduced. The effect of inaccuracies in the molding of the wafer or of the housing can be minimized since each switch arm wafer is separately located within the housing.

In the disclosed specific embodiment of this aspect, the first and second locating areas comprise first and second steps, and the first and second switch arm wafers are sized such that the first switch wafer fits to the first step and inside of the second step, and the second switch arm wafer fits to the second step and overlaps the first. In addition, the first and second locating areas comprise sections of one or more posts, each post having a first section with a first larger diameter and a second section with a second smaller diameter. The first switch wafer defines a locating hole with a diameter larger than the first diameter, and the second switch wafer defines a locating hole with a diameter smaller than the first diameter but larger than the second diameter, so that the first switch wafer fits over the first section of each post whereas the second switch wafer fits over the second section of each post. In embodiments with three or more switch wafers (such as is illustrated below), additional steps may be included to accurately locate those wafers as well.

In alternative embodiments, in place of steps, there may be a continuous ramp, such that the first switch wafer is sized to intersect the ramp in a first locating area, but the second switch wafer is sized to intersect the ramp in a second locating area. Furthermore, in place of stepped posts, there may be one or more continuously tapering posts, such that the first switch wafer's locating hole causes the first switch wafer to engage the continuously tapering post in a first locating area, and the second switch wafer's locating hole causes the second switch waver to engage the continuously tapering post in a second locating area.

A further aspect of the invention relates to the arrangement of switch arms in the wafers. Specifically, at least one of the switch arm wafers includes switch arms made of different metals. This allows high current and low current switches to be mixed in a single set of arms, where the high current switches are formed with wider and/or more expensive metal arms, and/or with a more heavy-duty contact, and the lower current arms are made with narrower and/or less expensive metal arms, and/or with a less heavy-duty contact.

Along with the differing switch arm materials and widths for handling various current capacities, the timer of the present invention also includes alternate embodiments of the structure and location of the switch arms. In one embodiment, the timer includes a configuration of two or more arrangements of switch arms, each arrangement capable of carrying a different current. These arrangements are located on either side of an axial center line of the program cam with the tips of at least one set of the switch arms overlaying a semicircular area of the cam. The tips of at least the other set overlie the semicircular area of the cam, on the opposite side of the axial center line relative to the first semicircular area. Alternatively, the arrangement of switch arms may be entirely located on one side of the axial centerline of the program cam, with the tips of those switch arms overlaying the corresponding semicircular area of the cam.

The timer of the present invention also includes single point connections for electric dryer timers wherein the switch arms, as discussed above, form a connector or a plurality of connectors which are connected to the clothes-dryer by a single connector block. The block including this plurality of individual connectors is mounted and/or molded in an insulating structure with each individual connector attached to a wire or wires connected to various functions of the dryer.

Alternatively, in those embodiments of the timer of the present invention including arrangements of switch arms located on either side of an axial center line or on the same side of an axial center line, the timer may include a plurality of connector blocks. Each of these connector blocks is connected to at least two of the switch arms and includes a plurality of individual connectors mounted or molded in an insulating structure with each individual connector attached to a wire. A wire is connected to various components and/or functions of the dryer.

An additional aspect of the invention relates to the arrangement of the geartrain and timing motor. The timing motor comprises a stator plate and a rotor mounted for rotation in the stator plate. The geartrain comprises meshing gears positioned on both opposite sides of the stator plate for providing a gear reduction of the rotation of the timing motor. By mounting the geartrain directly to the timing motor stator and including meshing gears on both opposite sides of the stator plate, the size of the timing motor and geartrain assembly can be substantially reduced as compared to prior systems in which the timing motor is contained within a separate housing and the geartrain is positioned entirely outside of this housing.

Another aspect of the timer of the present invention is the ability of the timer to provide a three-contact switch in which all three contacts may simultaneously be connected together. This capability can have useful application in some environments, and potentially reduce the number of switches that are needed.

BRIEF DESCRIPTION OF THE DRAWINGS

FIG. 7A is an exploded view of the setting feedback system of the timer of the present invention.

FIG. 7B is a partially cutaway view of the timer of the present invention depicting the setting feedback system in the setting mode.

FIG. 7C is a partially cutaway view of the timer of the present invention as shown in FIG. 7B wherein components of the setting feedback system have been sectioned in half to display the interaction of the latch and key mechanisms of the setting feedback system.

FIG. 7D is a partially cutaway view of the timer of the present invention depicting the positioning of the setting feedback system during the operational mode of the timer.

FIG. 7E is a partially cutaway view of the timer of the present invention depicting the positioning of the setting feedback system during the operational mode of the timer, wherein components of the setting feedback system have been sectioned in half to display the interaction of the latch and key mechanisms of the setting feedback system.

FIG. 7F is a partially cutaway view of the timer of the present invention depicting the travel limiting boss and the setting feedback system in the setting mode.

DETAILED DESCRIPTION

Figure 1:
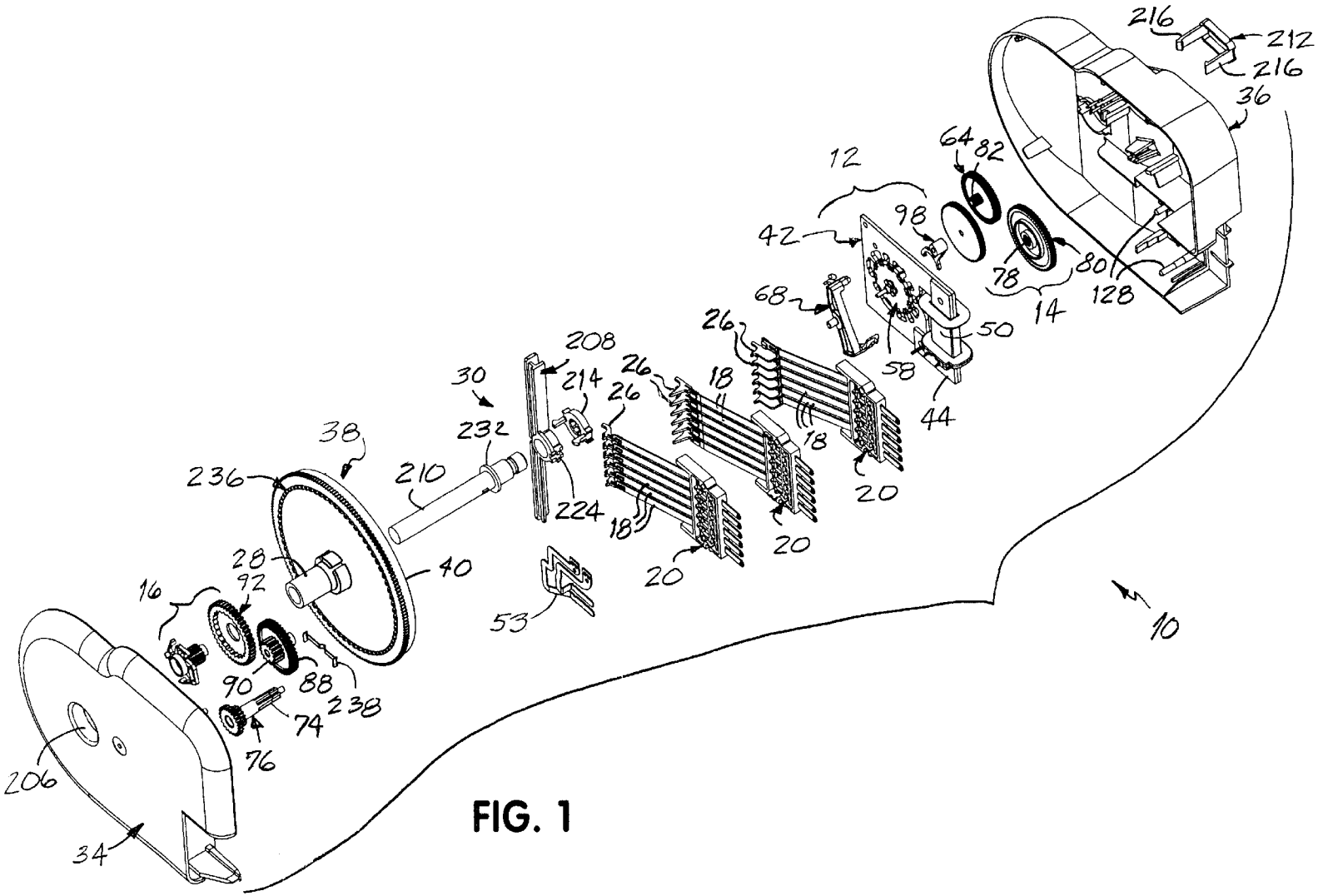
FIG. 1 is an exploded view of the cam-operated timer of the present invention.

The present invention avoids the drawbacks and solves the problems discussed in the background of the invention above. As shown in FIG. 1, the present invention provides a cam-operated timer 10 including a flat timing motor 12 and split geartrain 14 assembly, a one-way clutch mechanism 16, switch arms 18 for handling both standard and heavy duty electrical operations, a method of locating switch arm wafers 20 in the timer 10, electrical contacts 22 having lanced faces 24, insert molded arm cam followers 26 attached to the switch arms 18, a cam hub extension 28 for testing the operation of the timer 10 following assembly, and a setting feedback system 30.

More particularly, depicted in FIG. 1 is the illustrated embodiment of the cam-operated timer 10 of the present invention. As can be seen, the timer 10 includes a front housing 34 and a rear housing 36. Contained within the front housing 34 and rear housing 36 are the various components of the timer 10, including the flat timing motor 12 and split geartrain 14 assembly. A Westclox motor, including a flat stator plate with a rotor is known in the prior art.

The timing motor 12 and geartrain 14 drive the main cam 38 of the timer 10. A plurality of program cam surfaces 40 are continuous about and integral with the face of the main cam 38 and provide a geometry to be contacted by the cam followers 26 of the switch arms 18. As the main cam 38 rotates, the varying contours of these program cam surfaces 40 move the switch arms 18 of the timer 10 between neutral and offset positions. A plurality of these switch arms 18 are housed in a common wafer 20.

The movement of the switch arms 18 relative to one another results in the activation and deactivation of electrical circuits which operate the cycles of the appliance (not shown) to which the timer 10 is associated. The wafers 20 containing switch arms 18 are located in the rear housing 36 of the timer 10 over molded stepped plastic posts 128 in order to increase accuracy in the timer 10 of the present invention. The switch arms 18 include insert molded cam followers 26 which actively contact and follow the geometry of the program cam surfaces 40 of the main cam 38. The switch arms 18 may be constructed of various materials depending on their use.

The cam-operated timer 10 of the present invention further includes a hub extension 28 protruding outside the front housing 34 of the timer 10. This hub extension 28 is integral with the main cam 38. Following assembly of the timer 10, the hub extension 28 is used for testing the operation of the switch arms 18 of the timer 10. By the particular configuration of the components of the hub extension 28, all timers produced may be tested by the same testing device following assembly.

The cam-operated timer 10 of the present invention also includes a setting feedback (SF) system 30. By this SF system 30, cam followers 26 are lifted off the program cam surfaces 40 so that a single shaped leaf spring, e.g., a "V"-shaped (or alternatively "U"-shaped) follower 238 remains in contact with a custom feel profile 236 on the side of the main cam 38 proximal the front housing 34. This "V"-shaped follower 238 acts as a tactile and/or audible feedback member, by engaging the textured surface of the custom feel profile 236 to impart such tactile feel to the user during rotation of the main cam 38. Each of the above-described features of the cam-operated timer 10 of the present invention will be discussed in greater detail below.

Figure 2A:
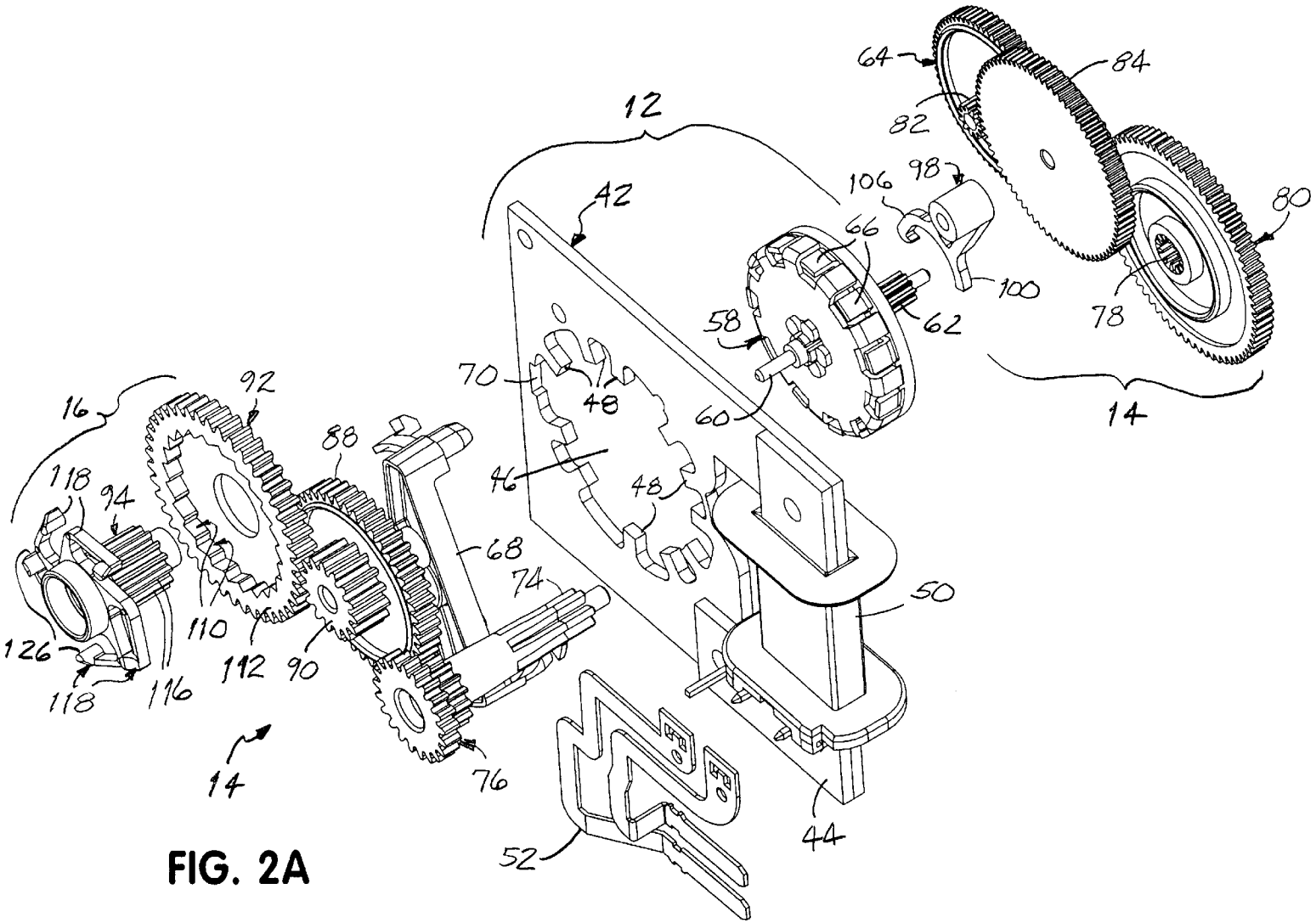
FIG. 2A is an exploded view of the flat motor and split geartrain assembly of the timer.
Figure 2B:
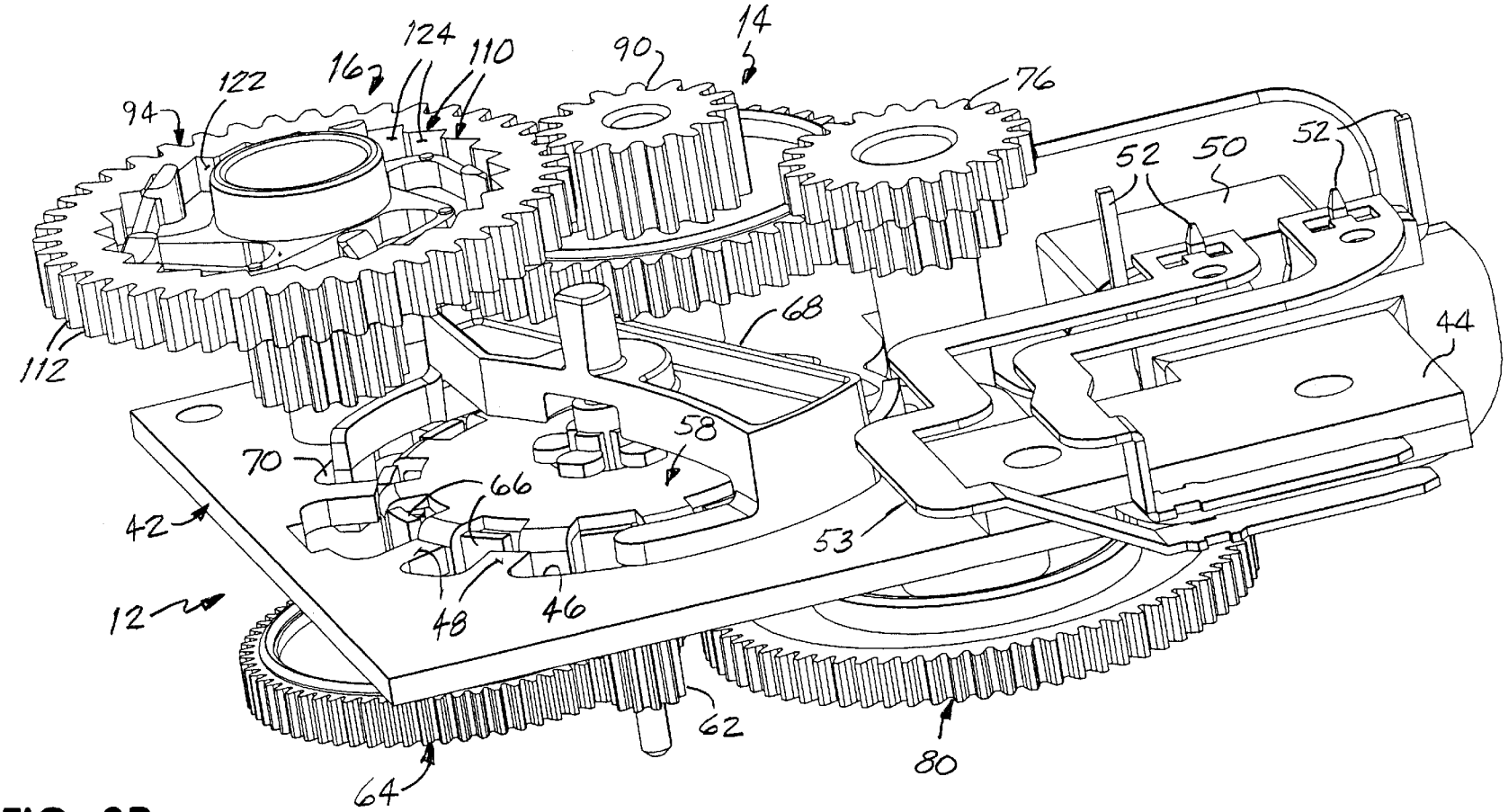
FIG. 2B is a perspective view of the flat motor and split geartrain assembly of FIG. 2A, particularly depicting the geartrain sub-assembly journalled in the front housing of the timer.
Figure 2C:
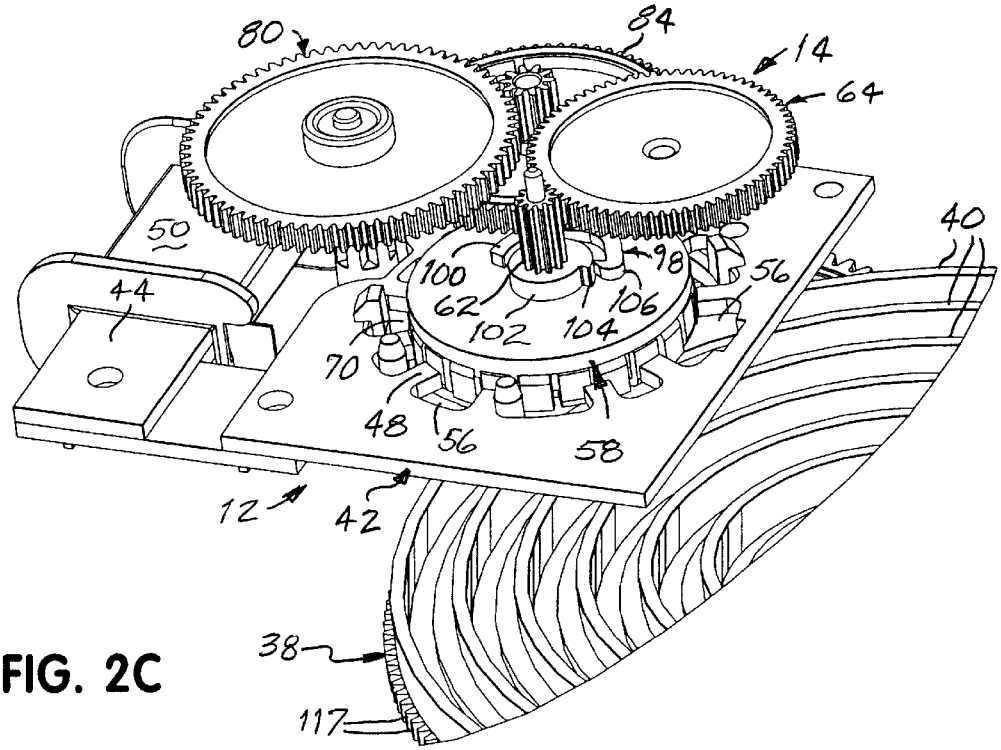
FIG. 2C is a perspective view of the flat motor and split geartrain assembly of FIG. 2A, particularly depicting the geartrain sub-assembly and main cam as they would be arranged when journalled in the rear housing.

As shown in FIGS. 2A through 2C, the illustrated embodiment of timer 10 of the present invention includes a timing motor 12 and geartrain 14 assembly to drive the main cam 38 of the timer 10. The timing motor 12 includes a stator plate 42 and an L-bracket 44. The stator plate 42 is formed from a flat steel stamping, and includes an orifice 46, the circumference of which is bounded by a plurality of stator poles 48. The timing motor 12 of the present invention also includes a rectangular bobbin coil 50 having square wire terminals 52 that plug into buss bars 53 in the timer 10. The stator plate 42, L-bracket 44 and bobbin coil 50 are located in the rear housing 36 of the timer 10 over molded plastic posts 54 (see FIG. 3). A locating hole and plurality of details 56 are formed through the flat steel stamping of the stator plate 42. In assembling the stator plate 42 into the rear housing 36 of the timer 10, the molded plastic posts 54 (see FIG. 3) integral with the rear housing 36 are disposed through the locating hole and details 56 in the stator plate 42.

The timing motor sub-assembly also includes a rotor 58, which is disposed within the orifice 46 in the flat steel stamping of the stator plate 42. The rotor 58 includes a steel rotor post 60 extending through the body of the rotor 58 in a direction substantially perpendicular to the plane of the stator plate 42. This rotor post 60 is journalled in a socket 72 (see FIG. 3) molded in and integral with the rotor holding clip 68 of the timer 10. The opposite end of the rotor post 60 includes a rotor pinion 62 operatively connected to a first stage gear 64 of the geartrain 14. The rotor 58 is free to rotate on rotor post 60 within the housing of the timer 10. The rotor 58 additionally includes a plurality of rotor poles 66 along its outer circumference.

The rotor 58 is held in place by a rotor holding clip 68 which spans the orifice 46 in the stator plate 42. The rotor holding clip 68 is disposed through air gaps 70 in the stator plate 42 formed in orifice 46 between stator poles 48. The section of the rotor holding clip 68 spanning orifice 46 includes a socket 72 (see FIG. 3) in which rotor post 60 is disposed to provide an axis of rotation for rotor 58. The rotor holding clip 68 also prevents the rotor 58 from falling out during final assembly.

The operation of the timing motor occurs by a magnetic field flowing around and through the stator poles 48 and rotor poles 66. The rotor 58 has a single permanent magnet (not shown) within its body producing flux along the direction of the axis of rotation. Electrical current is applied to the winding of the bobbin coil 50 attached to the stator plate 42, producing alternating flux passing through the stator plate 42. This causes the rotor 58 to move in synchrony with the flux in the stator plate 42. The stator poles 48 in the surface of the stator plate 42 adjacent to the position of the rotor 58 help to focus the flux. Since there is no forming required, rotor 58 to stator pole 48 air gaps can be controlled much more accurately than in the traditional round cup style timing motor where the poles are formed and susceptible to bending. The bobbin coil 50 is also much more efficient in this flat timing motor 12 than in a round timing motor. Since the magnet wire is wrapped around only the steel instead of around the rotor 58, much less wire is required to achieve magnetic saturation of the stator plate 42.

The geartrain 14 driven by the timing motor sub-assembly provides a constant speed of rotation to the main cam 38 and is split on both sides of the stator plate 42. As a result, all gear and pinion meshes are completed during sub-assembly operations and the only blind assembly is mating a splined shaft 74 on a third stage pinion 76 with a splined socket 78 on a third stage gear.80. The rotor pinion 62, first stage gear 64, a first stage pinion 82, a second stage gear 84, a second stage pinion 86 (shown in FIG. 2C) and the third stage gear 80 are located over molded posts 54 (see FIG. 3) or sockets (not shown) integral with the rear housing 36 of the timer 10. These components are assembled and the timing motor sub-assemblies positioned over them and staked in place. The third stage pinion 76, a fourth stage gear 88, a fourth stage pinion 90, a fifth stage gear 92 and a fifth stage pinion 94 and the main cam 38 are assembled over molded posts or sockets (not shown) in the front housing 34 of the timer 10. The rear housing 36 is then inverted and snapped in place over the front housing 34, capturing the entire timing motor 12 and geartrain 14. During the final assembly operation, the splined shaft 74 on the third stage pinion 76 mates with a splined socket 78 on the third stage gear 80 completing the geartrain 14.

In operation, as the rotor 58 is driven by magnetic flux across stator poles 48 and rotor poles 66, the rotor pinion 62 rotates, thereby rotating the first stage gear 64 to which rotor pinion 62 is operatively connected. First stage pinion 82 (see FIG. 2A) rotates cooperatively with first stage gear 64 and in turn, rotates second stage gear 84, to which first stage pinion 82 is operatively connected. Second stage pinion 86 rotates cooperatively with second stage gear 84 and in turn, rotates third stage gear 80, to which second stage pinion 86 is operatively connected. Third stage pinion 76 rotates cooperatively with third stage gear 80 and in turn, rotates fourth stage gear 88, to which third stage pinion 76 is operatively connected. Fourth stage pinion 90 rotates cooperatively with fourth stage gear 88 and in turn, rotates fifth stage gear 92, to which fourth stage pinion 90 is operatively connected. Fifth stage pinion 94 rotates cooperatively with fifth stage gear 92 and in turn, drives the main cam 38 of the timer 10 to which fifth stage pinion 94 is operatively connected. At the same time, square wire terminals 52 of the bobbin coil 50 mate with buss bars 53 located in the front housing 34 of the timer 10, providing two isolated electrical terminals for the timing motor under the standard switch block terminals. In this manner, assembly of the timer 10 is effected with the connection of the splined shaft 74 of the third stage pinion 76 to the socket 78 of the third stage gear 80 being the only blind assembly. This enhances the ease of assembly, thereby reducing error in assembly and subsequent failure of the timer 10.

The geartrain 14 of the present invention also includes an anti-backup clip 98. The anti-backup clip 98 is formed from plastic and is disposed about the axis of rotation of the second stage gear 84. The anti-backup clip 98 includes an arm 100 split on opposite sides of the base 102 of the rotor pinion 62. The base 102 of the rotor pinion 62 includes a finger 104 which protrudes from the base. The anti-backup clip 98 includes a clip finger 106 which follows the circumferential geometry of the base 102 of the rotor pinion 62 as it rotates cooperatively with the rotor 58. The interaction of finger 104 and clip finger 106 will only permit rotation of the rotor 58 in one direction (counter-clockwise as shown in FIG. 2C). In this manner, the proper direction of rotation of the rotor 58 is insured upon the start of the timing motor 12.

In another embodiment of the cam-operated timer 10 of the present invention, the geartrain 14 may include a run indicator (not shown). Since appliances tend to make noise during operation, it is desirable to have a run indicator to determine whether the timer 10 is running. To this end, the tip of the splined third stage pinion 76 shaft has an arrow (not shown) molded on the end of it and extends through a hole (not shown) in the rear housing 36. When viewed from the rear of the timer 10, if the arrow is rotating (approximately one r.p.m.), the timing motor is running.

Figure 2D:
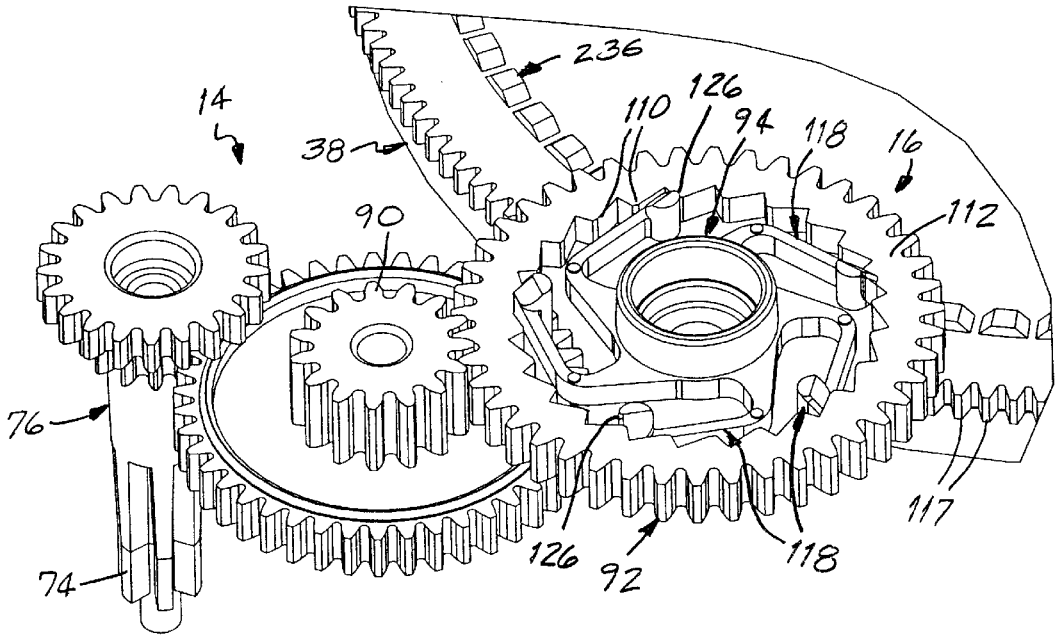
FIG. 2D is a perspective view of the clutch mechanism, geartrain and main cam of the timer.
Figure 2E:
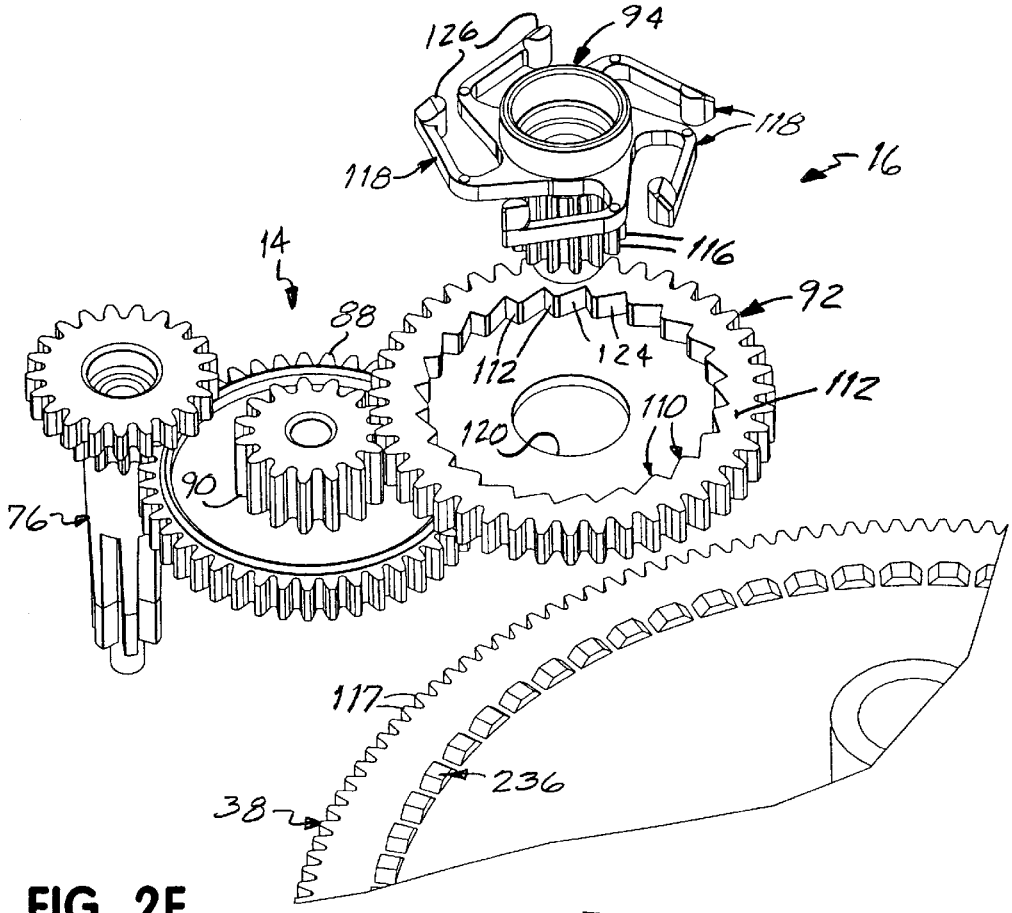
FIG. 2E is an exploded view of the clutch mechanism, geartrain and main cam of the timer.

As depicted in FIGS. 2A through 2E and most particularly in FIGS. 2D and 2E, the geartrain 14 assembly of the present invention includes a clutch mechanism 16 which allows manual rotation of the main cam 38, only in a forward direction. During manual operation of the main cam 38, any unchecked rotation of the cam 38 in a reverse direction may result in damage to various components of the timer 10, particularly the switch arms 18. To eliminate the possibility of such damage and to allow the timer 10 to be manually set by advancing the cam 38 in a forward direction, the geartrain 14 will not slip relative to the main cam 38 during attempted manual reverse rotation of the cam, thus preventing any such reverse rotation. However, the clutch mechanism 16 allows slip between the geartrain 14 and the cam 38 when the main cam 38 is manually advanced.

The clutch mechanism 16 for the constant speed drive system of the timer 10 of the present invention includes the fifth stage gear 92 and fifth stage pinion 94. The fifth stage gear 92 has a series of protrusions, hereinafter referred to as clutch teeth 110, about the inside circumference of the gear ring 112 of the fifth stage gear 92 on the face of the gear 92 most proximal to the front housing 34 of the timer 10. The outer periphery of this gear ring 112 includes the teeth of the fifth stage gear 92 that mesh with the teeth of the fourth stage pinion 90. The fifth stage pinion 94 includes a plurality of pinion teeth 116 disposed about the outer periphery of the fifth stage pinion 94. These pinion teeth 116 engage teeth on a gear ring 117 disposed about the outer periphery of the main cam 38. The fifth stage pinion 94 includes a plurality of clutch prongs 118 extending from the outer circumference of the fifth stage pinion 94 on the end distal to the pinion teeth 116. When the fifth stage pinion 94 is placed through an orifice 120 located through the center of the fifth stage gear 92, the pinion teeth 116 nest with the teeth on the gear ring 117 on the main cam 38 on the side of the fifth stage gear 92 distal to the front housing 34 of the timer 10. The end of the fifth stage pinion 94 including the clutch prongs 118 is thus disposed on the side of the fifth stage gear 92 most proximal to the front housing 34 of the timer 10. During this engagement, the clutch prongs 118 of the fifth stage pinion 94 abut the clutch teeth 110 located about the inner circumference of the fifth stage gear 92. In this relationship, each clutch tooth 110 includes a flat side 122 that is substantially perpendicular to the longitudinal axis of the clutch prong 118 to which it is associated and a ramped side 124 that is substantially parallel to the longitudinal axis of the clutch prong 118 to which it is associated.

Referring to FIGS. 2D and 2E, the clutch mechanism 16 of the timer 10 of the present invention functions as follows: During normal operation of the timer 10, as the fourth stage pinion 90 rotates (clockwise in FIG. 2D) and drives the fifth stage gear 92 (counter-clockwise), the clutch teeth 110 move cooperatively with the fifth stage gear 92 such that the flat sides 122 of the clutch teeth 110 abut the distal tips 126 of the clutch prongs 118 of the fifth stage pinion 94. As discussed, these flat sides 122 are substantially perpendicular to the longitudinal axis of the clutch prongs 118 such that the prongs 118 cannot slip past the clutch teeth 110. This causes the fifth stage pinion 94 to rotate cooperatively (counter clockwise) with the fifth stage gear 92. The fifth stage pinion 94 in turn is operatively connected to a gear ring 117 on the periphery of the main cam 38, thereby resulting in the forward rotation of the main cam 38 (clockwise). Thus, during normal operation of the timer 10, the geartrain 14 and main cam 38 of the timer 10 are engaged.

In the situation in which the main cam 38 is advanced manually in order to set the timer 10, the progression of rotation proceeds from main cam 38, to fifth stage pinion 94, to fifth stage gear 92, and so on back down the geartrain 14. Thus, the fifth stage pinion 94, being operatively connected to the main cam 38, will rotate (counter-clockwise in FIG. 2D) as the main cam 38 is advanced (clockwise). As the fifth stage pinion 94 rotates, the clutch prongs 118 of the fifth stage pinion 94 abut and slide over the ramped side 124 of the clutch teeth 110. As discussed, these ramped sides 124 are substantially parallel to the longitudinal axis of the clutch prongs 118 to which they are associated, thus offering little resistance to the movement of the prongs 118 with respect to the clutch teeth 110. This action causes the clutch 16 to slip and allows the timer 10 to be manually set due to slip permitted by the geartrain 14 relative to the main cam 38.

In the situation in which the main cam 38 is attempted to be reversed manually, the clutch mechanism 16 will prevent any such reverse rotation of the main cam 38. Upon attempted reverse rotation of the main cam 38 (counter-clockwise in FIG. 2D), the fifth stage pinion 94 will rotate (clockwise) cooperatively with the main cam 38 so that the distal tips 126 of the clutch prongs 118 abut the flat sides 122 of the clutch teeth 110 that are substantially perpendicular to the longitudinal axes of the prongs 118. In this position, the clutch prongs 118 cannot slide over the clutch teeth 110. Thus, the clutch 16 does not slip, and the geartrain 14 does not permit slip relative to the main cam 38. The forces applied due to friction and the gear ratio of the geartrain 14 thus prevent reverse manual rotation of the main cam 38.

Figure 2F:
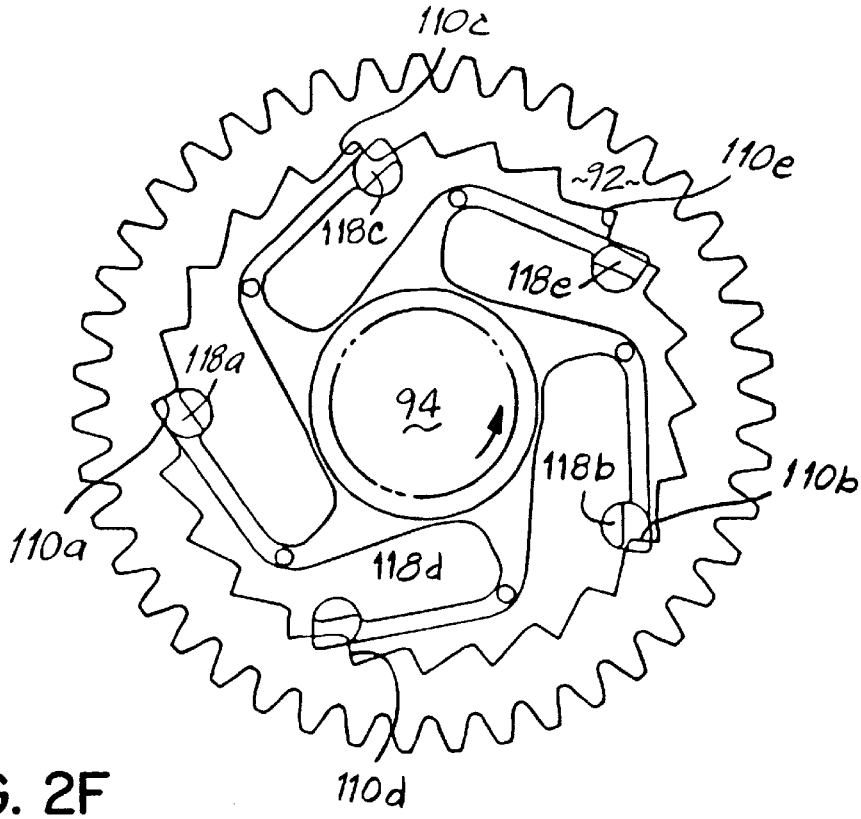
FIG. 2F is a view of the outline of the clutch teeth of the fifth stage gear superimposed on the outline of the clutch prongs of the fifth stage pinion when the prongs are in their relaxed position.

Referring now to FIG. 2F, details of the interaction of the clutch teeth 110 on the fifth stage gear 92 and clutch prongs 118 on the fifth stage pinion 94 can be explored. FIG. 2F shows the outline of the teeth of fifth stage gear 92 superimposed on the outline of the prongs 118 of fifth stage pinion 94 in its relaxed position. This shows the relative sizes of these parts. It will be appreciated that when the prongs 118 of the fifth stage pinion 94 are meshed with the teeth 110 of fifth stage gear, the prongs will be flexed (with the exception of the single prong that may be aligned as is the case with prong 118*a* in FIG. 2F).

The clutch prongs 118 are circumferentially spaced so that the prongs 118 do not simultaneously align with the clutch teeth. Specifically, there are five prongs circumferentially spaced about the fifth stage pinion 94, and twenty-four teeth 110 circumferentially spaced about the fifth stage gear 92; the prongs 118 and teeth 110 are arranged such that exactly one prong 118 aligns with exactly one tooth 110, and drops into engagement with the tooth in the manner of prong 118*a* and tooth 110*a*, every three (360/24·5) degrees of relative rotation of the fifth stage pinion 94 and fifth stage gear 92.

Furthermore, the prongs 118 are spaced so that, from a position where a tooth and prong are aligned, three degrees of relative rotation will bring another prong 118 and tooth 110, on approximately the opposite side of the fifth stage pinion 94 and fifth stage gear 92, into alignment. As seen in FIG. 2F, prong 118*a* on the fifth stage pinion 94 is aligned with a tooth 110*a* on the fifth stage gear 92. Three degrees of relative counterclockwise motion of fifth stage pinion 94 relative to fifth stage gear 92 will bring prong 118*b* into alignment with tooth 110*b*. A further three degrees of relative motion will bring prong 118*c* into alignment with tooth 110*c*. Another three degrees will bring prong 118*d* into alignment with tooth 110*d*. A final three degrees of motion will bring prong 118*e* into alignment with tooth 110*e*. This allows for a maximum of three degrees of backlash in the clutch, which is desirable to prevent damage from reverse motion of the cam. Furthermore, if a heavy load is placed on the clutch such that the currently engaged prong is flexed, after only three degrees of reverse rotation, a second prong 118 will engage with its corresponding tooth 110 on the opposite side of the pinion 94 and gear 92, causing the torque load to be shared between two prongs on opposite sides.

Figure 3:
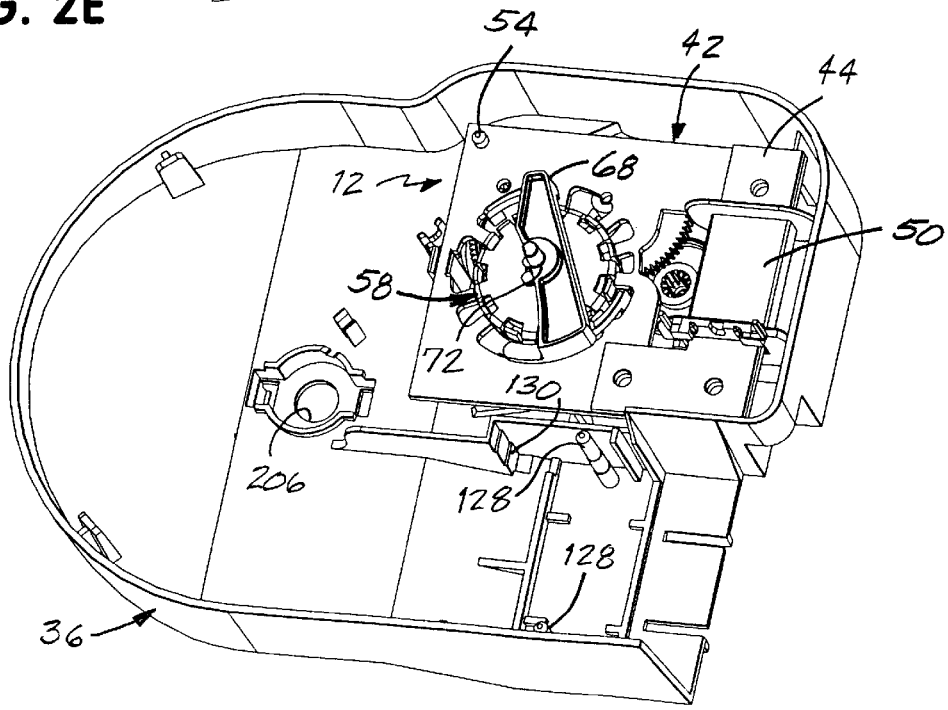
FIG. 3 is a perspective view of the rear housing of the timer containing the flat motor and geartrain sub-assembly.

Referring now to FIG. 3, the flat stator plate 42, L-bracket 44 and rotor 58 of the timing motor sub-assembly 12 are depicted as mounted in the rear housing 36 of the timer 10 over molded plastic posts 54. Additionally, stepped locating posts 128 and stepped walls 130 are shown. These posts 128 and walls 130 are used to locate wafers 20 containing a plurality of switch arms 18 in the rear housing 36 of the timer 10. During normal operation of the timer 10, as the main cam 38 advances, the program cam surfaces 40 on the face of the main cam 38 result in movement of the switch arms 18. The movement of the switch arms 18 causes electrical contacts 22 (see FIGS. 4A, 5A) to be made, thereby operating the cycle of the appliance to which the timer 10 is associated.

Figure 4A:
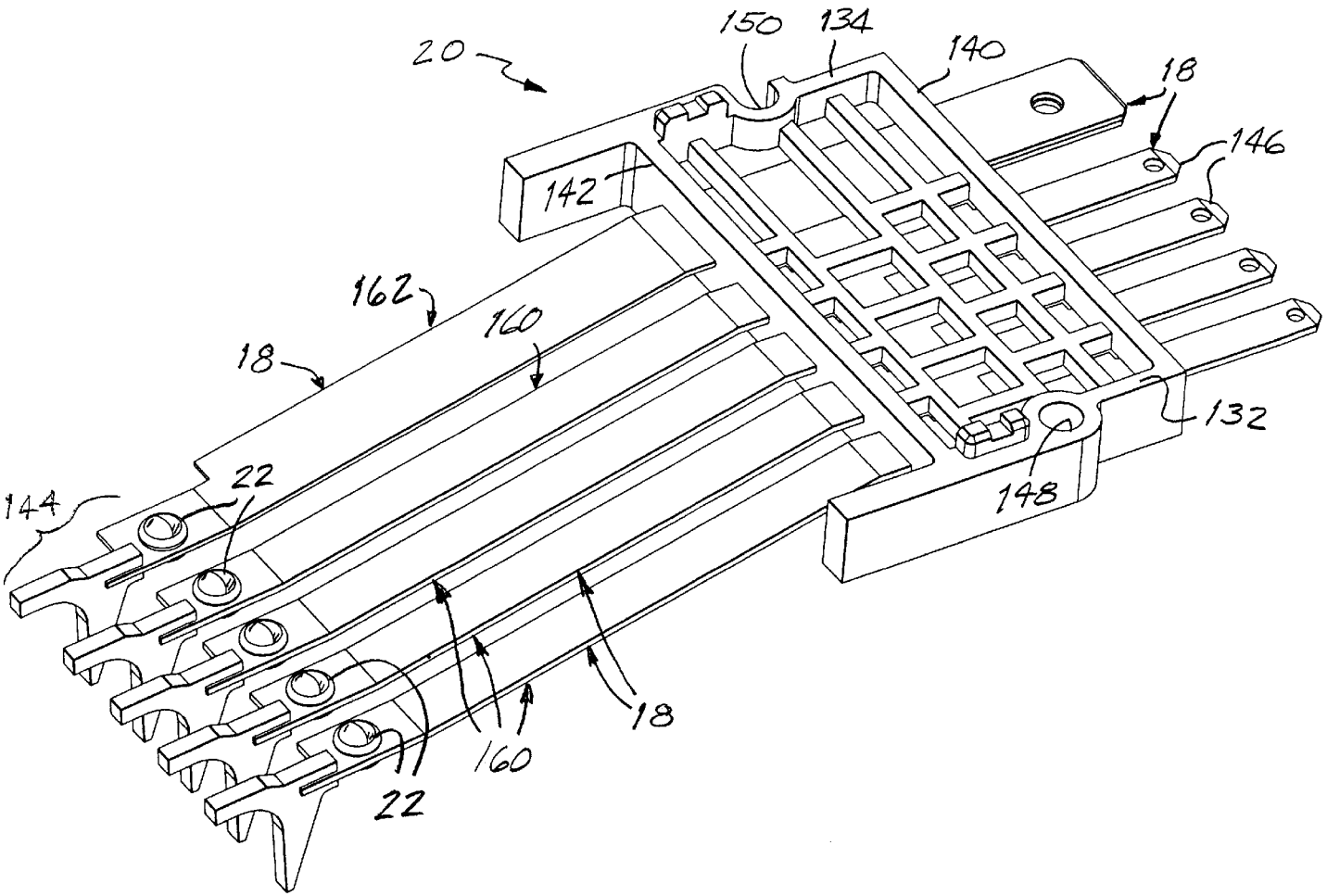
FIG. 4A is a perspective view of a switch arm wafer having a plurality of switch arms including electrical contacts and cam followers.
Figure 4B:
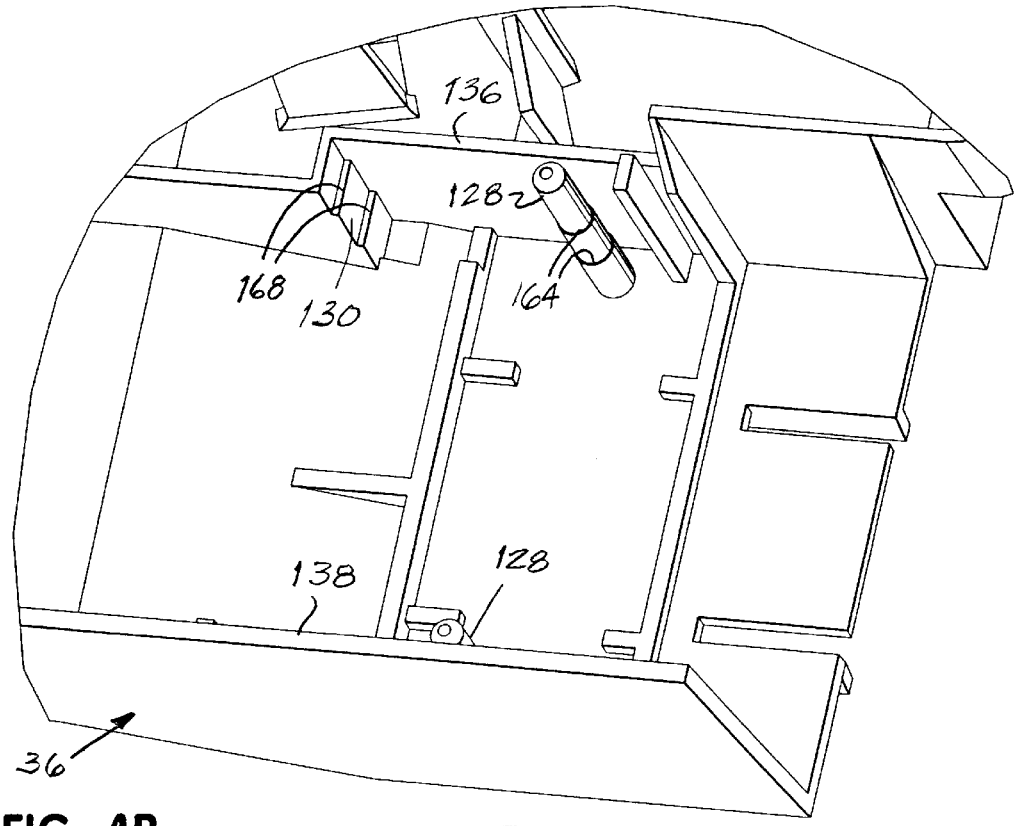
FIG. 4B is an enlarged view of the switch wafer mounting area of the rear housing shown in FIG. 3.
Figure 4C:
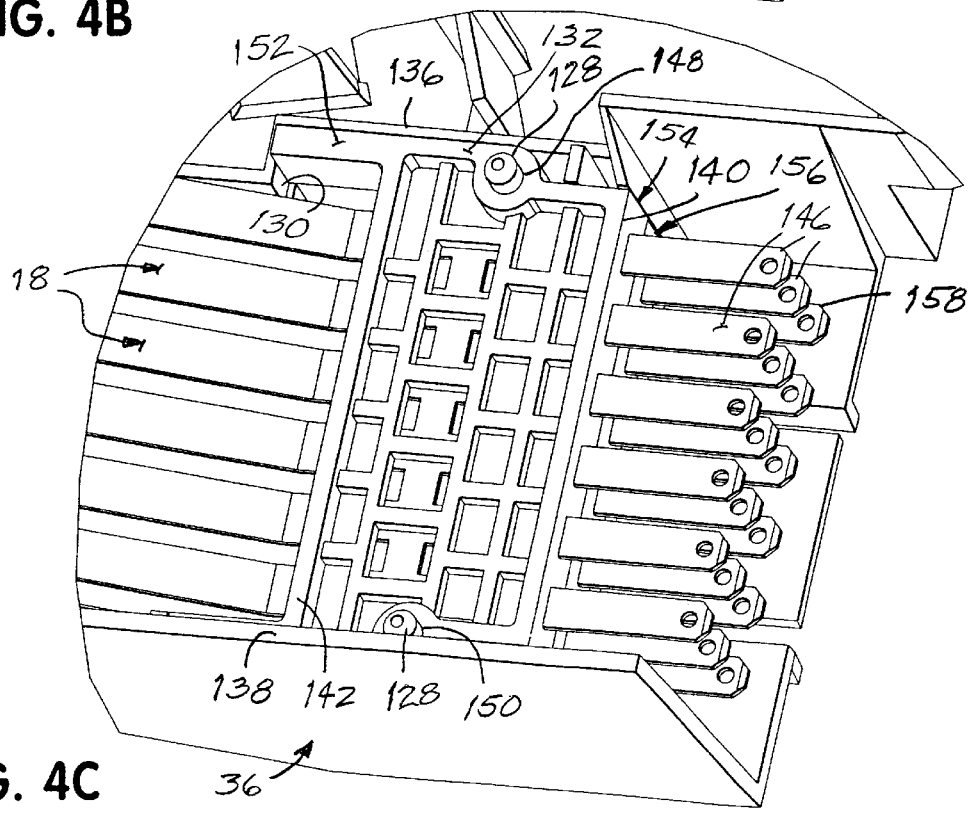
FIG. 4C is a perspective view of the rear housing of FIG. 4B containing a plurality of switch arm wafers in a stacked configuration.

As shown more particularly in FIGS. 4A through 4C, the switch arms 18 of the timer 10 are contained in a common switch arm wafer 20, which is disposed over plastic posts 128 in the rear housing 36 of the timer 10. The wafer 20 is injection molded from a suitable thermoplastic material, and carries a plurality of switch arms 18. The wafer 20 of the illustrated embodiment of the present invention is of a generally rectangular shape, having an end face 140, a terminal face 142 and two slides 132, 134 which abut walls 136, 138 integral with the rear housing 36. The switch arms 18 are molded into the wafer 20 with distal ends 144 (see FIG. 4A) projecting as cantilevers from the end face 140 of the wafer 20. Terminals 146 of the switch arms 18 project oppositely from the terminal face 142 of the wafer 20. The switch arm wafer 20 additionally includes a locating hole 148 and a locating notch 150, through which the plastic locating posts 128 are disposed. The wafer 20 also includes wafer arms 152 which extend from the end face 140 of the wafer parallel to and in the same direction as the distal ends 144 of the switch arms 18. In the illustrated embodiment of the timer 10 of the present invention, three switch arm wafers 154, 156, 158 are located in the rear housing 36 of the timer 10 in a stacked configuration. Each switch arm 18 molded into a wafer 20 may be made of the same material as or different materials from the other switch arms 18.

Referring to FIG. 4A, the structure of switch arms 18 contained within a wafer 20, is shown. In the illustrated embodiment of the timer 10 of the present invention, at least one of the switch arms 18 is made of a different size and material than the remainder of the switch arms 18. The switch arm wafer 20 shown includes a plurality of standard switch arms 160 and one heavy duty switch arm 162. As developed in the background of the invention, the switch arms 18 of quick connect appliance timers 10 are generally all made of the same material and have terminals that are 0.125 inches wide by 0.020 inches thick. Such switch arms 18 operate well for applications where the electrical loads are handled well by standard alloy brass material and a ⅛ inch terminal size. In certain appliances however, such as an electric dryer, switch arm materials and terminals capable of handling greater heater loads in addition to the more typical loads of other appliances, may be necessary. In order to handle such increased current requirements, the timer 10 of the present invention includes at least one heavy duty switch arm 162. This heavy duty switch arm 162 is made of a material with better electrical properties than standard alloy brass. An example of such a material would be copper alloy 194 or 197. The heavy duty switch arm 162 of the present invention is also greater in width than the standard switch arms 18. In the illustrated embodiment of the present invention, the heavy duty switch arm 162 is about ¼ inch wide. Since copper alloy is more expensive than brass alloy, the copper alloy is used only for the heavy duty switch arms 162 required to control the greater current requirements, while using less expensive brass alloys for the remainder of applications of the standard switch arms 160.

In the illustrated embodiment of the timer 10 of the present invention one heavy duty switch arm 162 is inserted molded with a plurality of standard switch arms 160 in a common wafer 20. Three wafers 154, 156, 158 will then be stacked one on top of another together to provide the switching functions required for the application of the device to which the timer 10 is associated. By providing only one heavy duty switch arm 162 with the more expensive copper alloy the costs of the timer 10 are reduced and a timer 10 which can handle increased 25 amp circuit requirements is provided.

Figure 8:
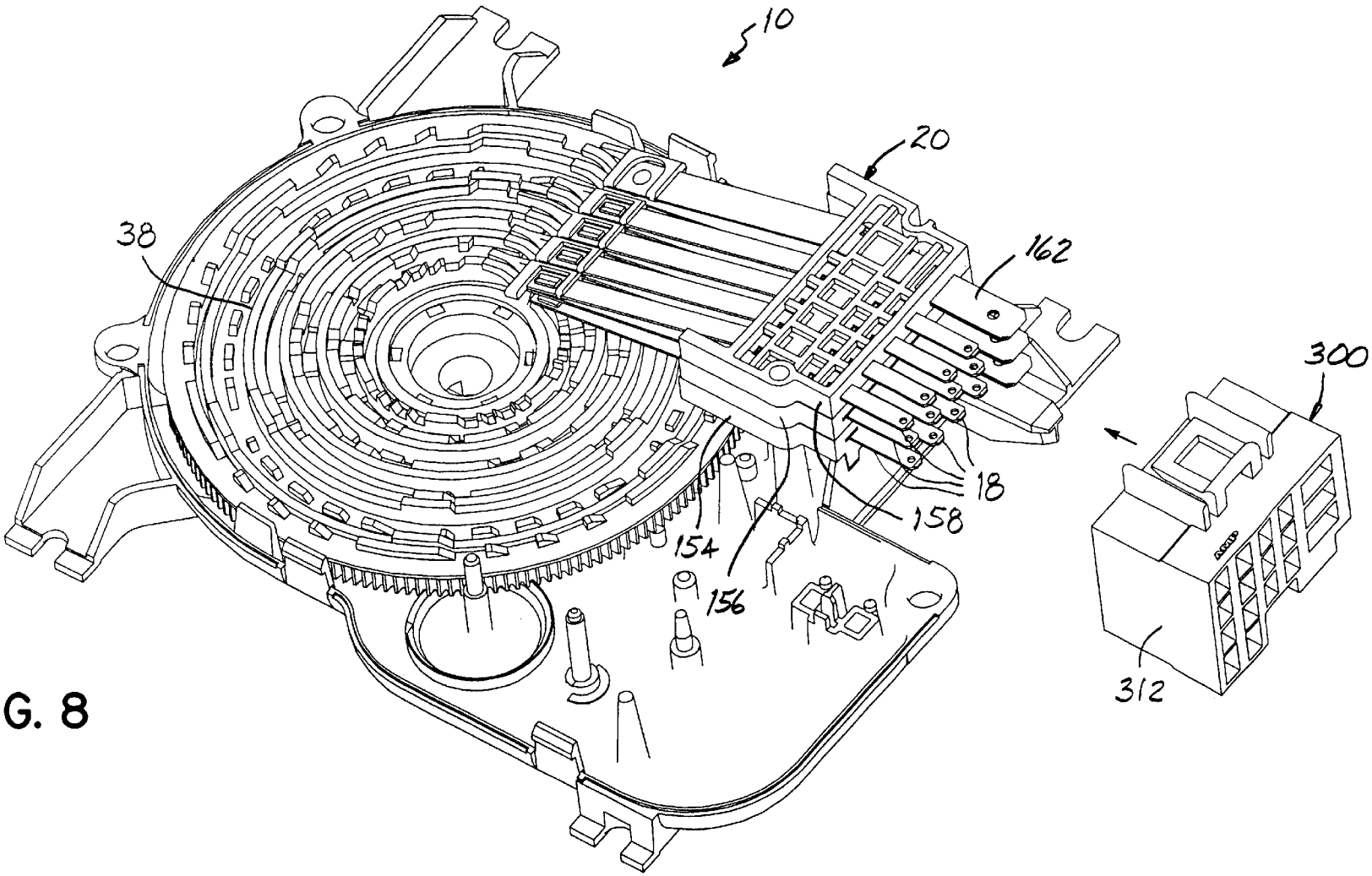
FIG. 8 is a perspective view of the timer of the present invention, including switch arms mounted in switch wafers and a connector block for attachment to the terminals of the switch arms.

Referring now to FIGS. 8–13, along with the heavy duty switch arm 162 having differing switch arms materials and/or different switch arm widths for handling various current capacities, the timer 10 of the present invention also includes alternate embodiments regarding the structure and location of the switch arms 18. In the timer 10 as described above, the switch arms 18 are attached in the three switch arm wafers 154, 156, 158, and, as can be seen in FIG. 8, are amenable to connection to a single connector block 300. However, referring to FIGS. 10 and 11 in particular, in a first alternate embodiment of the present invention, the timer 10 includes a configuration including two or more switchblock arrangements of switch arms 18 in wafers 20. Each of these arrangements includes at least one heavy duty switch arm 162, and therefore is capable of carrying greater electrical currents. These switchblock arrangements are located on opposite sides of an axial center line 314 of the program cam 38 with the distal ends of at least a first set 316 of the switch arms 18 overlaying a first semicircular area 320 of the cam-carrying member 38. The distal ends of the second set 318 of switch arms 18 will overlie a second semicircular area 322 of the cam 38, located on the opposite side of the axial center line 314 from the first semicircular area 318.

In particular, in this first alternate embodiment of the timer 10 of the present invention, the timer 10 includes a plurality of cam-actuated switches 18, with each switch having at least a first and second metal arm. A plurality of these arms 18 are then mounted in a first switch arm wafer 154 and a plurality of the arms 18 are mounted in a second switch arm wafer 156. As can be seen from the Figures, these first and second switch wafers 154, 156 are then mounted in the timer 10 as stacked atop one another. Additionally, the timer 10 of the first alternate embodiment may include a plurality of switch arms 18 mounted in a third wafer 324 and a plurality of switch arms 18 mounted in a fourth wafer 326. These third and fourth wafers 324, 326 are also stacked atop one another. The first and second wafers 154, 156 are then located on a first side 320 of the axial center line 314 of the cam-carrying member 38 and the third and fourth wafers 324, 326 are located on a second side 322 of the axial center line 314 of the cam-carrying member 38. As a result of the respective locations of the first and second, and third and fourth wafers 154, 156, 324, 326, the switch arms 18 of the first and second wafers 154, 156 overlie a first semicircular area 320 defined by the outer periphery of the cam-carrying member 38 and the axial center line 314. Likewise, the switch arms 18 mounted in the third and fourth wafers 324, 326 overlie a second semicircular area 322 of the cam-carrying member 38 on the opposite side of that axial center line 314 from the first and second wafers 154, 156. Additionally, as will be appreciated by those having skill in the art, the timer 10 may include any number of wafers.

Figure 9:
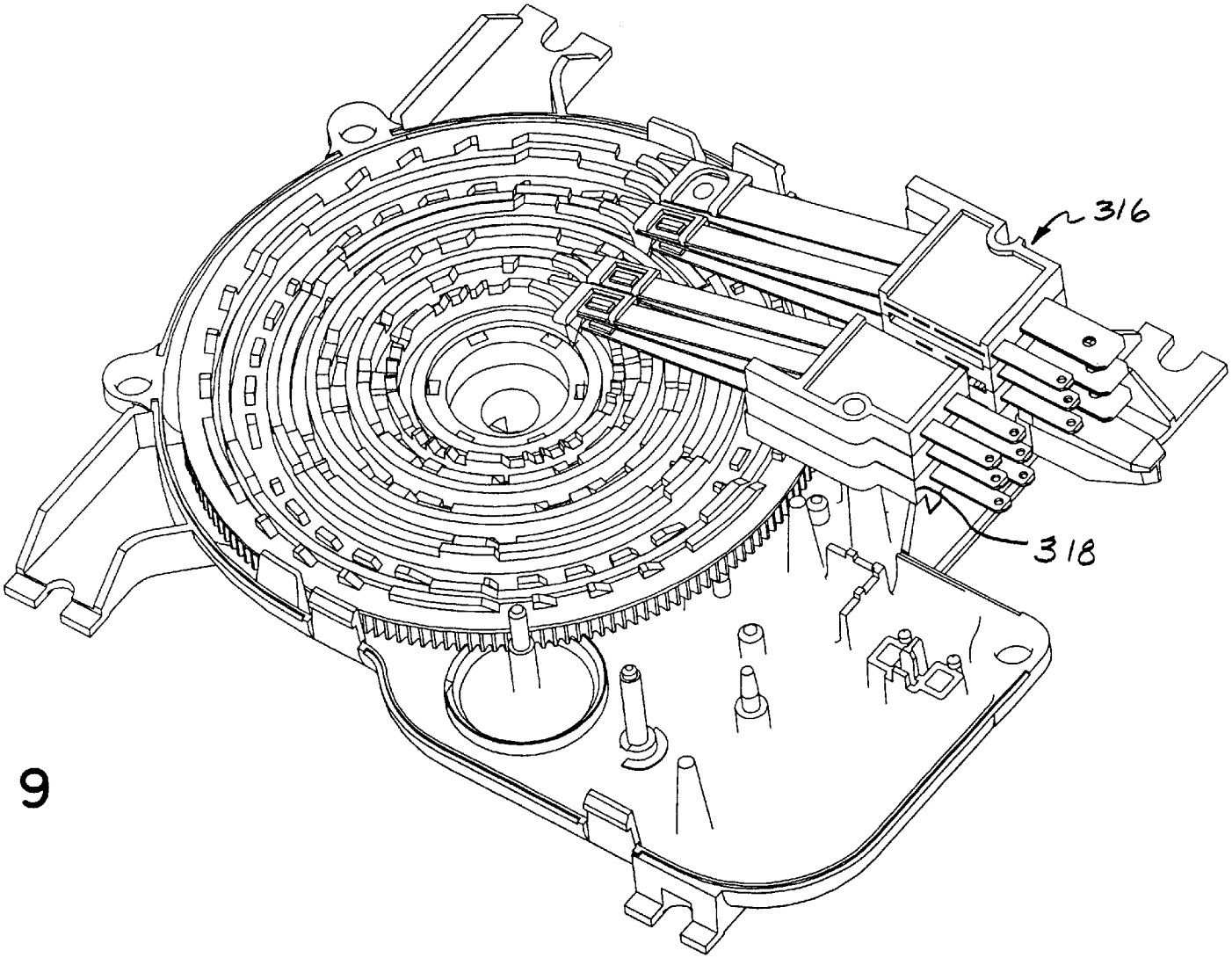
FIG. 9 is a perspective view of the timer of the present invention depicting an alternate embodiment having two switch blocks located on one side of an axial center line of the cam carrying member.
Figure 10:
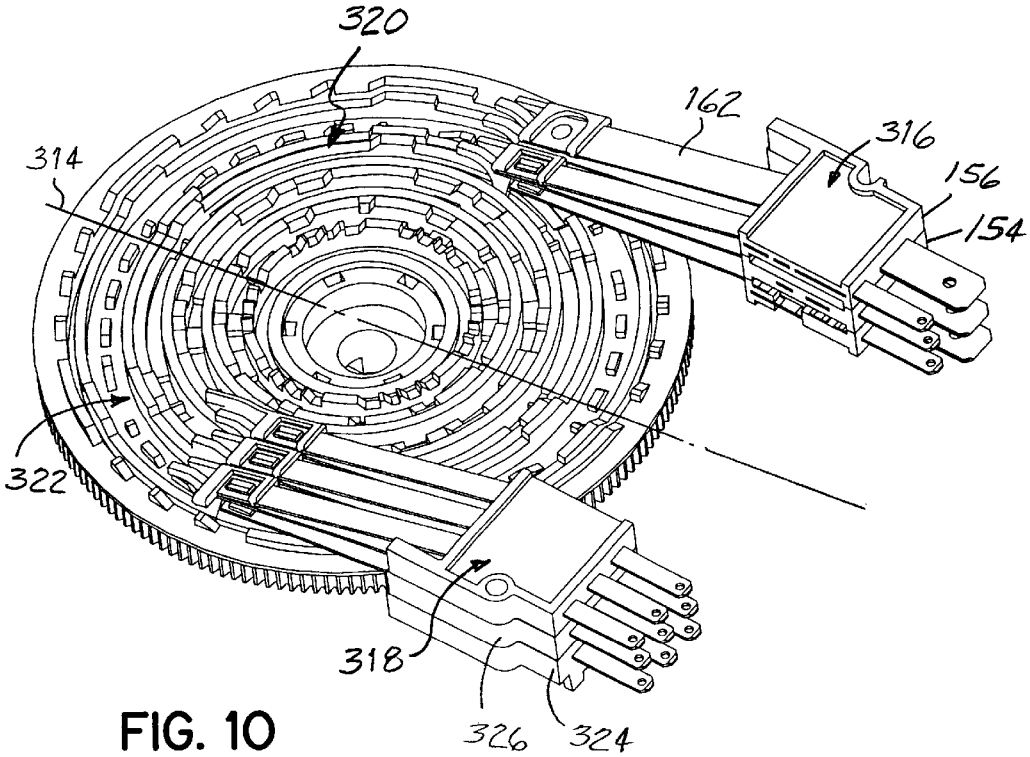
FIG. 10 is a perspective view of the timer of the present invention depicting an alternate embodiment of the two switch block configuration, having switch blocks located on opposite sides of the axial center line of the cam carrying member.
Figure 11:
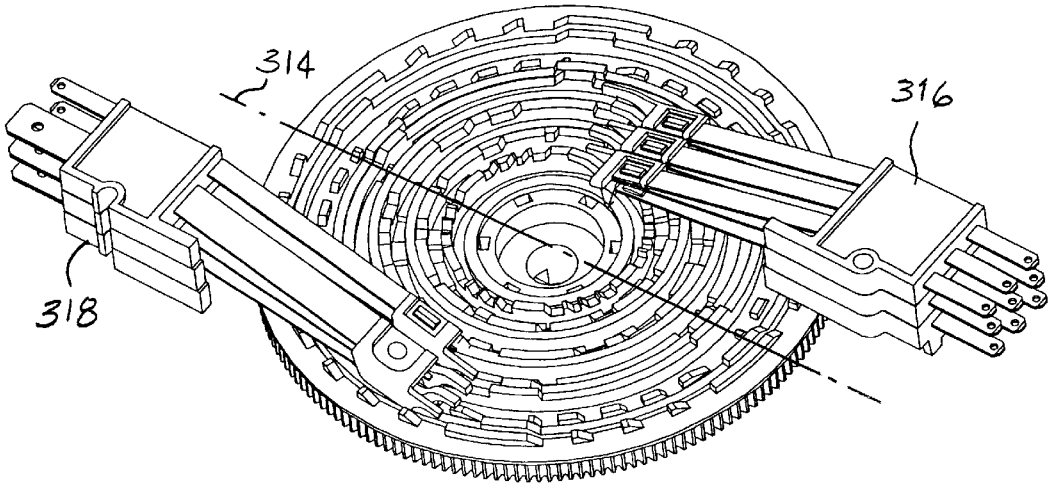
FIG. 11 is a perspective view of the timer of the present invention depicting the alternate embodiment having two switch blocks, with each switch block located on opposite sides of an axial center line of the cam carrying member.

In a second alternative embodiment, two or more arrangements of switch arms 18 may be located entirely on one side of the axial centerline 314 of the program cam 38. In such a configuration, the distal ends of those switch arms 18 will overlie a corresponding semicircular area, such as 320, of the cam 38 (as depicted in FIG. 9).

As described previously, the timer 10 of the present invention also includes single point connections for electric dryer timers wherein the switch arms 18, as discussed above, form a connector or a plurality of connectors which are connected to the clothesdryer by a single connector block 300. The block 300 including this plurality of individual connectors 310 is mounted and/or molded in an insulating structure 312 with each individual connector 310 attached to a wire or wires (not shown) connected to various components of the dryer.

Figure 12:
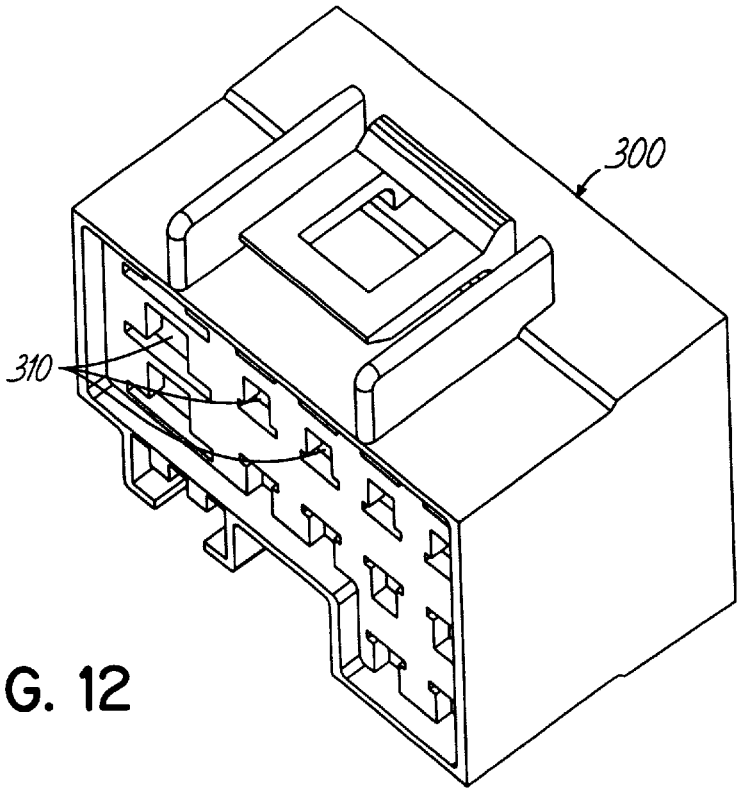
FIG. 12 is a perspective view of a connector block in accordance with the principles of the present invention, depicting connecting points for the terminals of the switch arms.
Figure 13:
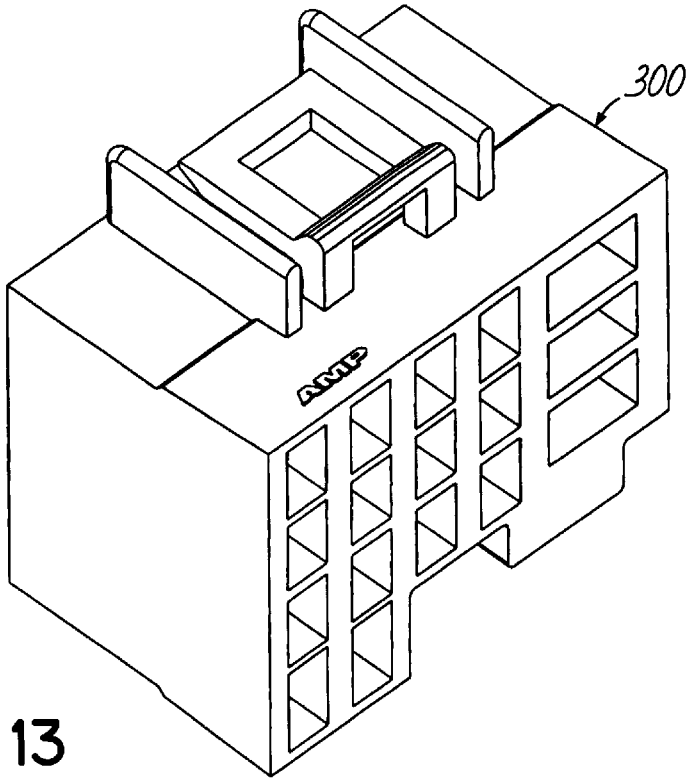
FIG. 13 is a perspective view of the connector block of FIG. 12 in accordance with the principles of the present invention, depicting the opposite face of the connector block.

Referring now to FIGS. 8, 12, and 13, views of the connector block 300 in accordance with the principles of the present invention are shown. As can be seen, the connector block 300 is operatively connected to the terminal ends of the switch arms 18 mounted in the switch wafers 20. The use of the connector block 300 eliminates the need for individual leads from each of the terminals to various components of the appliance, such as a dryer. In alternate embodiments of the present invention including two or more arrangements of switch blocks 316, 318, as discussed above, two or more connectors may be used with each connector attaching to a respective switch block. It will be appreciated by those skilled in the art that one connector block 300 may include terminals of different widths, materials, and/or current carrying capacities, or each of the plurality of connector blocks may include terminals having switch arms of different widths, materials, and/or current carrying capacities.

The connector switch block of the present invention replaces the individual wiring harness connections on standard dryer timers with one connector block containing both low and high amperage circuits. The present invention eliminates the need for high amperage connectors in dryer timers and minimizes connections which need to be made. An oversized connector within the plug is used for high amperage circuits and a regular sized connector in the plug is used for low amperage circuits, thereby creating a configuration by which the connector plug may only be attached to the circuits in the correct manner.

In one embodiment of the invention, the quick connector block 300 includes connectors having a capacity of at least 20 amps. In an alternate embodiment of the present invention, the quick connector block 300 of the present invention has a capacity in the range of about 15 amps to about 25 amps.

Referring now to FIGS. 4B and 4C, a method for locating switch arm wafers 20 in the rear housing 36 of the timer 10 of the present invention is depicted. As developed in the background of the invention, location of each switch arm 20 with respect to its counterparts in adjacent wafers 20 is critical for timing accuracy. Thus, the spacing and location of switch arm wafers 20 in their stacked configuration is integral to this accuracy. The wafer locating method of the timer 10 of the present invention eliminates the problem of maintaining tolerances over large surfaces in the switch mounting, and results in extremely accurate switch arm placement and thus, increased accuracy in the functionality of the timer 10.

As shown in FIG. 4B, plastic posts 128 are molded integral to the rear housing 36 of the timer 10. These posts 128 include steps 164 so that each section of post 128 of equal diameter to each successive step 164 corresponds to a particular switch arm wafer 20. In the illustrated embodiment of the present invention, each post 128 includes three sections of varying diameter to correspond to the three switch wafers 154, 156, 158 of the timer 10. Additionally, steps 168 operating as functional contours are molded into the wall 130 of the rear housing 36 of the timer 10 defining the boundary of location of the switch arm wafers 154, 156, 158.

FIG. 4C shows the three switch arm wafers 154, 156, 158 of the illustrated embodiment of the present invention disposed over the stepped posts 128 in a stacked configuration. The stepped posts 128 have a length of 0.600 inches in the illustrated embodiment of the present invention. Since the location of all three wafers 154, 156, 158 with respect to the cam 38 is critical for timing accuracy, the posts 128 are stepped 126 to eliminate the need for draft over the 0.600 inch length. Each wafer 20 is 0.200 inches thick, so every 0.200 inch length of the locating posts 128, the diameter of the post 128 is reduced by 0.010 inches. Thus, the locating hole 148 and locating notch 150 in the lower wafer 154 are 0.010 inches smaller in diameter than the locating hole 148 and notch 150 in the center wafer 156. In like manner, the locating hole 148 and notch 150 in the center wafer 156 are 0.010 inches smaller in diameter than the locating hole 148 and notch 150 in the upper wafer 158. Since only a small surface determines the position of the wafer in a direction orthogonal to the axis of rotation of the cam, a tight tolerance can be held for the location of each wafer 154, 156, 158.

As discussed, each wafer 20 also includes an arm 152 on each side of the wafer 20 extending from the end face 140 of the wafer 20 in the same direction as and substantially parallel to the distal end 144 of the switch arms 18. The end of each arm 152 is held in close relationship with the steps 168 of the wall 130 molded in the rear housing 36. This helps to resist the force exerted on the switch arm assembly 18 during mating of a connector plug. These wafer arms 152 are of varying lengths for the upper, center and lower wafers 158, 156, 154 of the present invention in order to correspond to the walls 130 in the rear housing 36 of the timer 10. Thus the wafer arm 152 of the lower wafer 154 is 0.020 inches longer than the wafer arm 152 of the center wafer 156. In like manner, the wafer arm 152 of the center wafer 156 is 0.020 inches longer than the wafer arm 152 of the upper wafer 158. As with the locating posts 128, the steps 168 of the walls 130 facilitate holding tight tolerances over relatively long vertical distances.

Figure 5A:
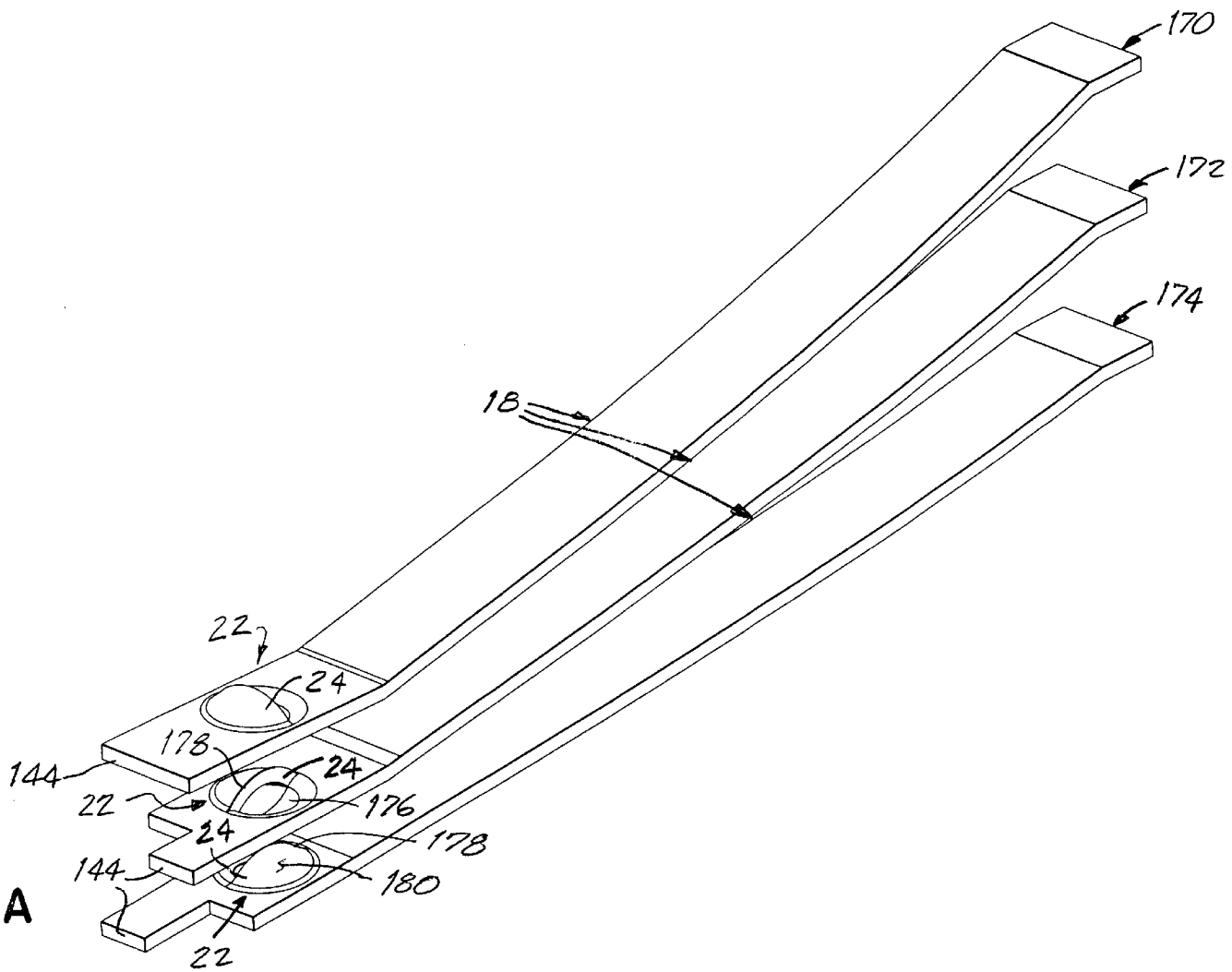
FIG. 5A is a perspective view of lanced contact faces on switch arms of the timer.
Figure 5B:
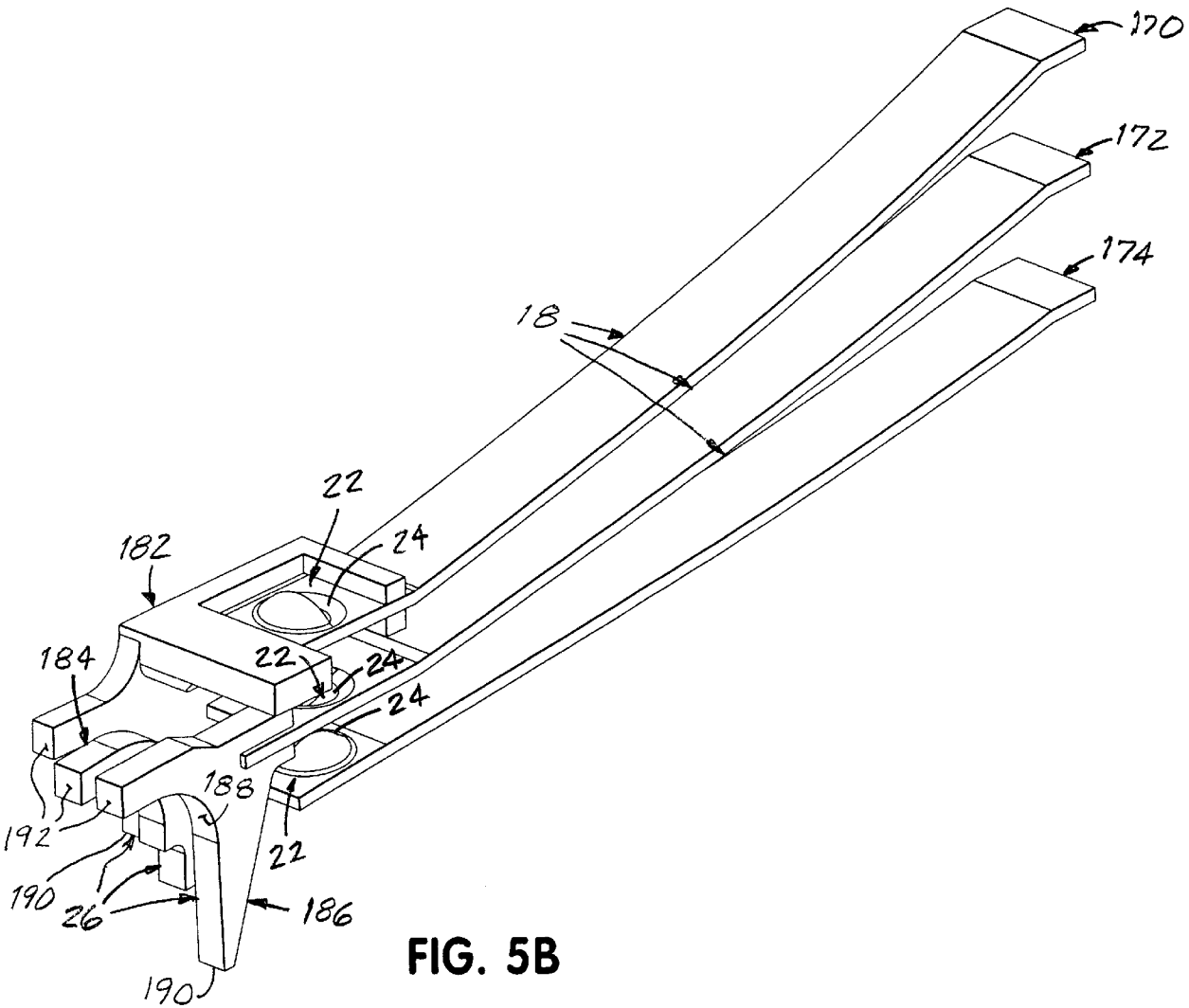
FIG. 5B is a perspective view of insert molded cam followers attached to switch arms of the timer.

Referring now to FIGS. 5A and 5B, two additional aspects of the switch arms 18 of the cam-operated timer 10 of the present invention are depicted: electrical contacts 22 having lanced faces 24 and cam followers 26 molded onto the distal ends 144 of switch arms 18.

As shown in FIG. 5A, electrical contacts 22 are located on the surfaces of each of the switch arms 18 at their distal end 144. These contacts 22 make and break electrical circuits that drive the various cycles of an appliance. As previously discussed and as shown in FIG. 4C, the illustrated embodiment of the present invention includes three switch arm wafers 154, 156, 158 in a stacked configuration and located in the rear housing 36 of the timer 10. Thus, three switch arms 170, 172, 174 will be disposed adjacent over one another in the illustrated embodiment of the present inception. Contacts 22 will be located on an upper switch arm 170, a center switch arm 172 and a lower switch arm 174. Generally, upper and lower switch arms 170, 174 will include contacts 22 on the surface proximal to the center switch arm 172, and the center switch arm 172 will include contacts 22 on both its upper and lower surfaces. Thus, circuits may be made between upper and center switch arms 170, 172 and between center and lower switch arms 172, 174. Additionally, circuits may be made between upper, center and lower switch arms 170, 172, 174 by having all three contact one another simultaneously.

The faces 24 of the electrical contacts 22 are lanced. Due to these lanced faces 24, the timer 10 of the present invention may be operated, and electrical circuits completed, even though corrosion may be present on the contacts 22 of the switch arms 18 and without using expensive silver alloy as a component of the contacts 22.

As developed in the background of the invention, contacts 22 used to switch low current devices often are comprised of precious metals. In such applications, the presence of any corrosion on the contacts 22 may prevent the electrical circuit from being completed. This problem is ameliorated by the high conductivity of precious metals. However, such metals are very expensive, thereby raising the cost of the product. To obviate the need for precious metals, other switches use dimpled switch arms. However, the dimpled switch arm material does not provide the corrosion resistance of a precious metal, and the dimple may only be formed on one side of the switch arm making it necessary to use a contact rivet for the center arm.

Lanced contacts solve the above-discussed problems. As shown in FIG. 5A, the lower contact 176 of the center switch arm 172 is provided with a lanced face 24 having a knife edge 178. The lanced face 24 of the opposing upper contact 180 of the lower switch arm 174 includes a similar knife edge 178 formed to contact the lower contact 176 of the center switch arm 172.

By providing a knife edge 178 on the lanced face 24 of the contact 22, an extremely high force is generated at the point of contact when the switch arms 172, 174 are moved as a result of the geometry of the program cam surfaces 40 to complete an electrical circuit. This high contact force on the sharp knife edges 178 of the lanced faces of contacts 176, 180 will cut through any corrosion or contamination that may be on the switch arms 172, 174, thereby reliably completing the electrical circuit. Second, the switch arm 18 can be lanced in both directions in the same location providing a raised lanced contact face 24 for both sides of the center switch arm 172. This eliminates the need to rivet a contact on one side of the center switch arm 172.

Although all of the contacts are shown as having lanced faces, it will be appreciated that only some of the contacts may be lanced, as desired, while obtaining the benefits described above.

Referring now to FIG. 5B, each switch arm 18 of the timer 10 of the present invention has an insert molded plastic cam follower 26 attached to the distal end 144 of the switch arm 18. The cam followers 26 are molded to the upper, center and lower switch arms 170, 172, 174 and move the switch arms 18 between neutral and offset positions as a result of the geometry of the program cam surfaces 40. Each cam follower 26 for a set of upper, center and lower switch arms 170, 172, 174 is associated with a single program surface 40 on the main cam 38. Thus, for each trio of switch arms 18 there are three dedicated program surfaces 40 on the main cam 38. The cam followers 26 molded to the upper arms 170 also provide an arc shield between each set of contacts 22. This type of molded tip design allows precise control of the location of each contact 22, improving contact air gap control and timing accuracy.

Since each switch arm 18 has its own molded plastic cam follower 26, the position of each switch arm 18 is controlled independently by the program cam surface 40 on the main cam 38 to which the cam follower 26 is associated. As such, the numerous possible configurations of switch arms 18 increases the variety of types of electrical contacts that can be made in the timer 10 of the present invention. For example, a set of switch arms (upper 170, center 172 and lower 174) can be operated as a conventional single-pole double-throw switch by allowing the upper and lower cam followers 182, 186, associated with the upper and lower switch arms 170, 174 respectively to ride on a constant cam level while the center switch follower 184, associated with the center switch arm 172, rides on neutral level for an off position, an upper offset position to complete the electrical circuit between the upper and center switch arms 170, 172, or a lower offset position to complete the circuit between the center and lower switch arms 172, 174. This configuration provides slow-make fast-break circuits at the upper and center switch arms 170, 172 and fast-make slow-break circuits at the center and lower switch arms 172, 174.

The set of switch arms 18 can also operate as a double-pole single-throw switch by allowing the center switch follower 184 to ride on a neutral cam level while the lower switch follower 186 rides on an upper offset position to make the circuit between the lower and center switch arms 174, 172, and the upper switch follower 182 rides on a lower offset position to make the circuit between the upper and center switch arms 170, 172. This configuration provides fast-make slow-break for circuits at the upper and center switch arms 170, 172 and slow-make fast-break for circuits at the center and lower switch arms 172, 174.

By combining these two different types of switch actions and allowing all three switch arms 170, 172, 174 to ride on various neutral or offset cam levels, it is also possible to provide fast-make fast-break and slow-make slow-break for both top and bottom circuits as well. Fast-make and break results in improved accuracy since a dropping switch arm action is well defined. Another advantage of fast-make and break is a reduced contact erosion and heating which results in increased switch life. Yet another advantage of a fast make and break is a reduction in duration of radio frequency interference due to the fact that the circuit is closed and opened instantaneously, providing instant contact force and instant air gap.

It will be noted that the independent control of the three switch arms 18 also permits the three switch arms of a group to be simultaneously connected together, e.g. by maintaining the center switch arm in a neutral position while driving the lower switch arm up into the center switch arm and allowing the upper switch arm to drop into contact with the center switch arm. The resulting three-way connection allows for switching possibilities that under some circumstances may be advantageous, and potential reduce the number of switches needed for a particular application.

The cam followers 26 also provide geometry for a setting feedback (SF) actuator 208 to raise the followers 26 off the program cam surface 40. When the cam followers 26 are raised, the main cam 38 can be rotated in either direction to set the timer 10 to a particular cycle. As shown in FIG. 5B, the front edge of each cam follower 26 includes an arcuate face 188 curving from the tip 190 of the cam follower 26 which contacts the main cam 38 at a direction substantially perpendicular to the program cam surfaces 40 of the main cam 38. This leading edge 192 extends from the distal end 144 of the switch arm 18 along the longitudinal axis of the switch arm 18. The arcuate surface 188 then curves 90° from that tip 190 to a leading edge 192 of the cam follower 26 that is substantially parallel to the program cam surface 40 of the main cam 38. The arcuate face 188 and leading edge 192 are engaged by the SF actuator 208 of the SF system 30 to lift the cam followers 26 off the program cam surface 40. The interaction of the SF actuator 208 and cam followers 26 will be explained in greater detail below.

Figure 6:
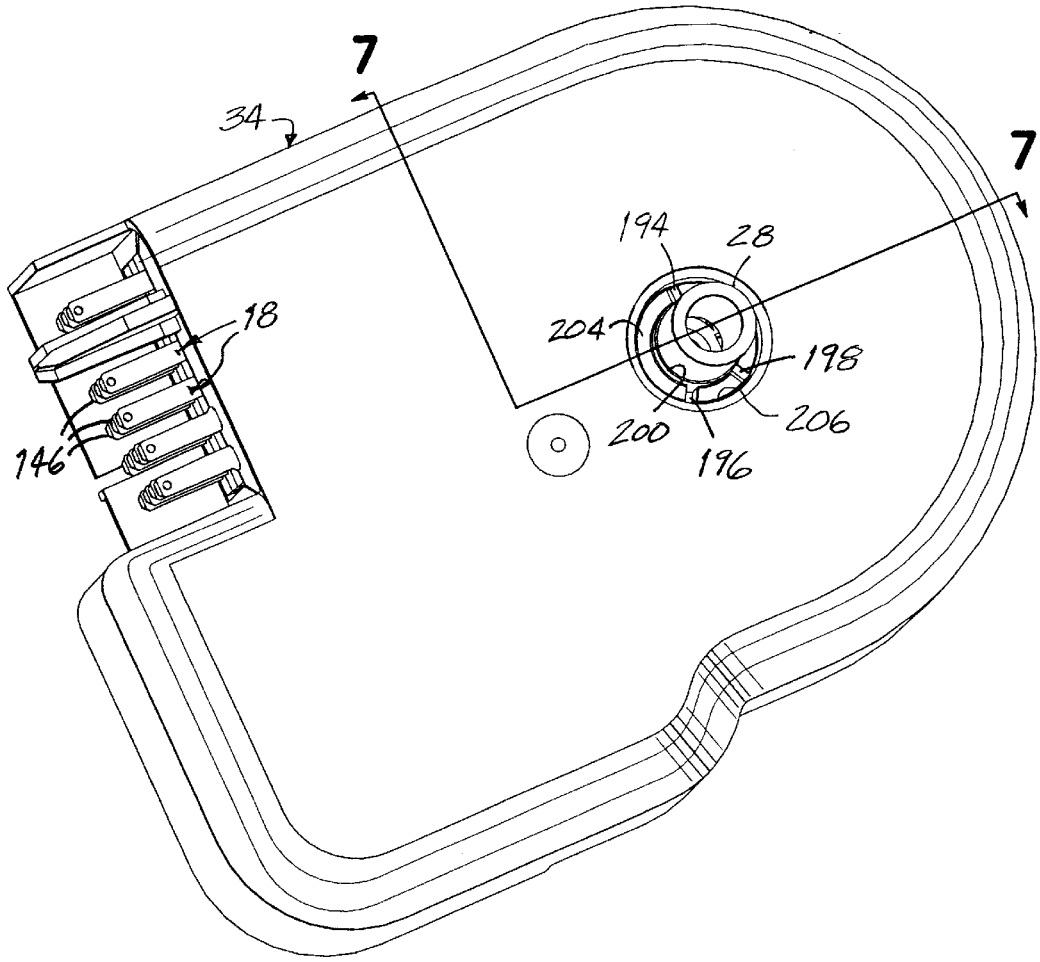
FIG. 6 is a perspective view of the front housing of the timer, depicting the hub extension for testing of the timer following assembly.

Referring now to FIG. 6, the structure of the timer 10 of the present invention involved during testing of the timer 10 is shown. Cam-operated timer 10 testing takes place after assembly has been completed. The purpose of the cam-operated timer 10 test is to test the operation of cam-operated timer 10 components, including the switch arms 18. This test verifies operation of the switch arms 18 by the program cam surfaces 40 of the main cam 38 and determines whether all electrical contacts 22 are properly made. The components of the timer 10 used during this test procedure include a hub extension 28 of the main cam 38 which extends outside the front housing 34 of the timer 10 and three "key" slots 194, 196, 198 located in the base 200 of the hub extension 28. During testing the cam-operated timer 10 is operatively connected to a test fixture that has a rotator (not shown) for rotating the main cam 38, and a data recorder (not shown) for verifying the response of the switch arms 18 to the program cam surfaces 40. The rotator is operatively connected to the hub extension 28 of the main cam 38 protruding from the front housing 34 of the timer 10. The data recorder is connected to the switch arms 18 for recording operation of the switch arms 18. Operation of switch arms 18 is determined by applying electrical voltage to selected contact terminals. The data recorder then measures whether a particular switch arm is opened or closed by measuring whether a voltage is present on the switch arm 18.

As developed in the background of the invention, the hub extension 28 protruding from the face of the front housing 34 of the timer 10 may be of a different shape and configuration for every model of timer 10. This makes it difficult for one piece of test equipment to test every timer 10 that is built. The timer 10 of the present invention incorporates a cam test hub 28 having features to facilitate testing of each timer 10 with a single piece of test equipment.

The hub extension 28, base 200 and a cam ring 204 are integral with the main cam 38 and extend through an orifice 206 in the front housing 34 of the timer 10. When the-timer 10 is fully assembled, the hub extension 28, base 200 and cam ring 204 are disposed outside the front housing 34 of the timer 10. The cam ring 204 includes three unequally spaced slots 194, 196, 198 and is located at the base 200 of the hub extension 28, below the front face of the timer 10 but disposed on the outside of the front timer housing 34. The cam ring 204 and slots 194, 196, 198 are integral with the hub extension 28 of the main cam 38. The isolated slot 194 operates as a zero tooling position of the cam 38 and the other two slots 196, 198 are provided for engagement by the test fixture to drive the cam 38. Since these three slots 194, 196, 198 will always be of the same configuration and in the same location with respect to the zero tooling location, the test equipment can use the same encoding and driving head for all models of timer 10.

During testing, the hub extension 28 of the main cam 38 is rotated by the rotator to which it is operatively connected. As the main cam 38 rotates the switch arms 18 operate in accordance with the main cam 38 by moving between neutral and offset positions as determined by the geometry of the program carried on the program cam surfaces 40. The hub extension 28 is rotated at a rate to rotate the main cam 38 360° in about e.g. two to ten minutes. This rate of rotation of the main cam 38 is greatly accelerated over the rate of rotation of the cam 38 during normal operation of the timer 10. The rate of rotation during testing is accelerated about e.g. ten to twenty times. Some cam-operated timer 10 configurations may require more time to rotate the main cam 38 and some may require less time to rotate the main cam 38. As the main cam 38 rotates, the data recorder collects data from the switch arms 18 during operation according to the program cam surfaces 40 of the main cam 38. The collected data from the data recorder is then used to determine whether the switch arms 18 are functioning properly.

Referring now to FIGS. 7A–7G, a set of switch arms (upper 170, center 172 and lower 174) are shown with their molded cam followers 26, and the operation of the SF system 30 is depicted. The SF actuator 208, which lifts the switch arms 18 off of the surface of the cam 38, is shown interacting with the followers 26. In the figures, the shaft 210 is shown in both the "in" and "out" positions. A latch 212, which holds the SF actuator 208 in a setting mode, is shown, along with a key 214, which releases the latch 212 to allow the SF actuator 208 to drop. When the shaft 210 is indexed "in", in a direction along the longitudinal axis of the shaft 210 and toward the rear housing 36 of the timer 10, the timer 10 is in a setting mode. In this setting mode, the latch 212 holds the SF actuator 208 in a raised position. In turn, the SF actuator 208 engages the cam followers 26 and holds the cam followers 26 out of engagement with the program cam surfaces 40 of the main cam. When the shaft is extended "out", in a direction along the longitudinal axis of the shaft 210 and away from the rear housing 36 of the timer 10, the key 214 displaces the latch 212 away from the SF actuator 208, which falls from its raised position and out of engagement with the cam followers 26. Thus, the cam followers 26 contact and follow the geometry of the program cam surfaces 40 as the main cam 38 rotates.

Figure 7A:
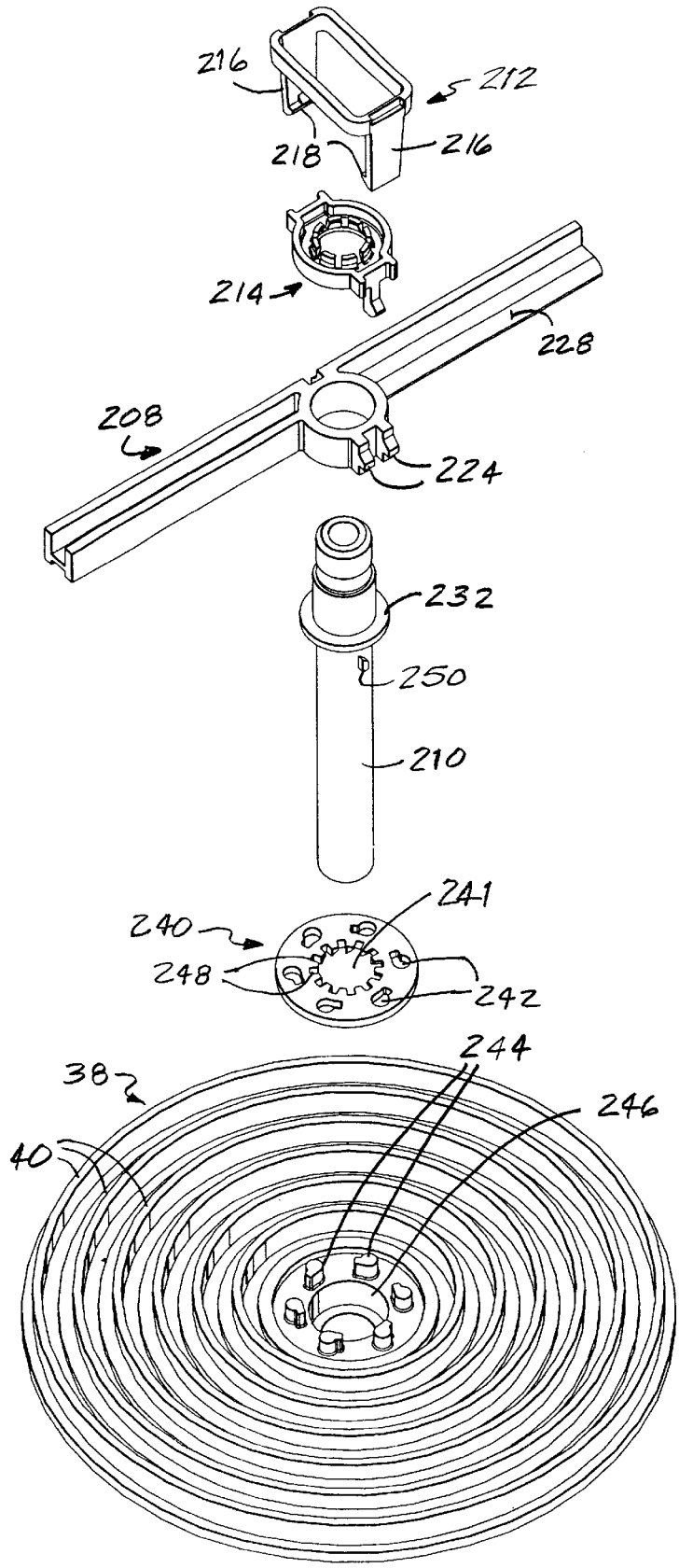
FIGS. 7A–7F are partial cut-away views along line 7 in FIG. 6.

During setting of the timer 10, the main cam 38 can be rotated in either a forward or a reverse direction. Referring to FIG. 7A, the SF system additionally includes a manual setting clutch plate 240. The clutch plate 240 includes a plurality of apertures 242 circumferentially disposed through the face of the clutch plate 240. These apertures 242 mesh with a plurality of protrusions 244 disposed on the face of the cam 38, and located about the circumference of an orifice 246 through the main cam 38. When the apertures 242 mesh with protrusions 244, the clutch plate 240 and main cam 38 rotate cooperatively. The clutch plate 240 also includes an orifice 241 disposed through its center. The outer circumference of this orifice 241 is defined by a plurality of notches 248. These notches may be engaged by a clutch pin 250 located on the shaft 210. When the timer 10 is in its operating position, the clutch pin 250 is not engaged with a notch 248 of clutch plate 240. Thus, the shaft 210 may be rotated without cooperative rotation of the main cam 38. However, when the shaft 210 is indexed into its setting position, the clutch pin 250 engages a notch 248 on the clutch plate 240. In this position, rotation of shaft 210 results in cooperative rotation of clutch plate 240 and main cam 38, thereby allowing the operator of the timer 10 to set the main cam 38 to a desired position.

Figure 7B:
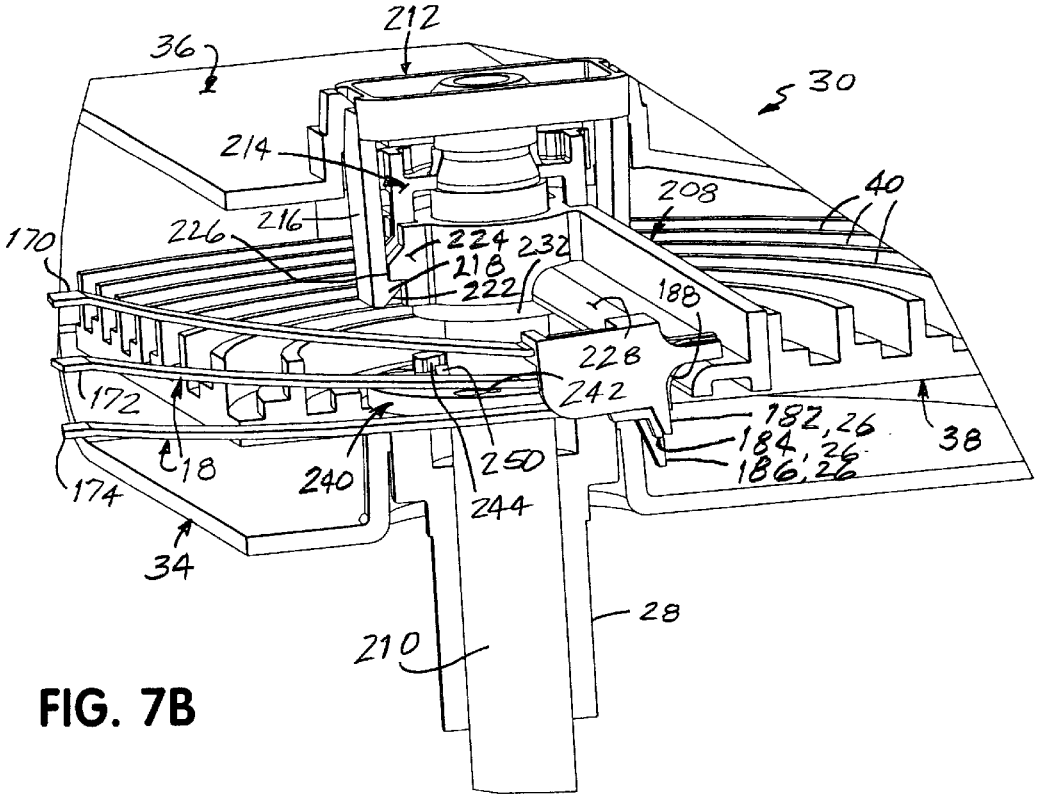

Referring to FIG. 7B, all of the components of the SF system 30 are shown in the setting position. The shaft 210 is axially movable in a longitudinal direction and has been indexed toward the rear housing 36 of the timer 10. In this position, the latch 212 holds the SF actuator 208 in a setting mode. When the latch 212 is released, the SF actuator 208 drops, allowing the switch arms 18 to contact the surface of the main cam 38. The shaft 210 and key 214, which are attached to the shaft 210 and shown as a cross-section, are also indexed in this setting position. In this position, the latch 212 of the SF system 30 engages the SF actuator 208. The latch 212 includes two latch arms 216, each having latch fingers 218 disposed at the distal ends of the arms 216. These latch fingers 218 include flat sections 220 and a latch ramp 222. The flat sections 220 operatively engage the SF actuator 208 and the latch ramp 222 engages the key 214. In particular, the flat sections 220 of the latch fingers 218 integral to the latch 212 support flat sections 226 of latching tabs 224 integral to the SF actuator 208.

As the shaft 210 is indexed toward the rear housing 36 of the timer 10, the latching tabs 224 of the SF actuator 208 slide past the latch fingers 218 of the latch 212. As the tabs 224 slide past the latch fingers 218, the fingers 218 are forced to move in a direction away from and substantially perpendicular to the longitudinal axis of the shaft 210. Once the tabs 224 have moved past the latch fingers 218, the fingers 218 and latch arms 216 return to their original position. In this position, the flat sections 220 of the latch fingers 218 engage the flat sections 226 of the latching tabs 224 to hold the SF actuator 208 in a raised position.

When the SF actuator 208 is held in a raised position, the tips of the cam followers 26 of the upper, center and lower switch arms 170, 172, 174 rest on the SF actuator 208, preventing the cam followers 26 from contacting the program cam surface 40 of the main cam 38. As the shaft 210 is indexed to move axially in a longitudinal fashion, the arcuate edge 228 of the SF actuator 208 engages the arcuate face 188 of the cam followers 26 attached to each switch arm 140. The arcuate face 188 of the cam followers 26 is inverted as compared to the arcuate edge 228 of the SF actuator 208. As the SF actuator 208 is raised cooperatively with the axial movement of the shaft 210 toward the rear housing 36 of the timer 10, the SF actuator 208 lifts up against the lower side of the leading edge 192 of the cam follower 170. As the shaft 210 is moved to its fully indexed position, the cam followers 26 are lifted out of contact with the program cam surfaces 40 of the main cam 38.

Figure 7C:
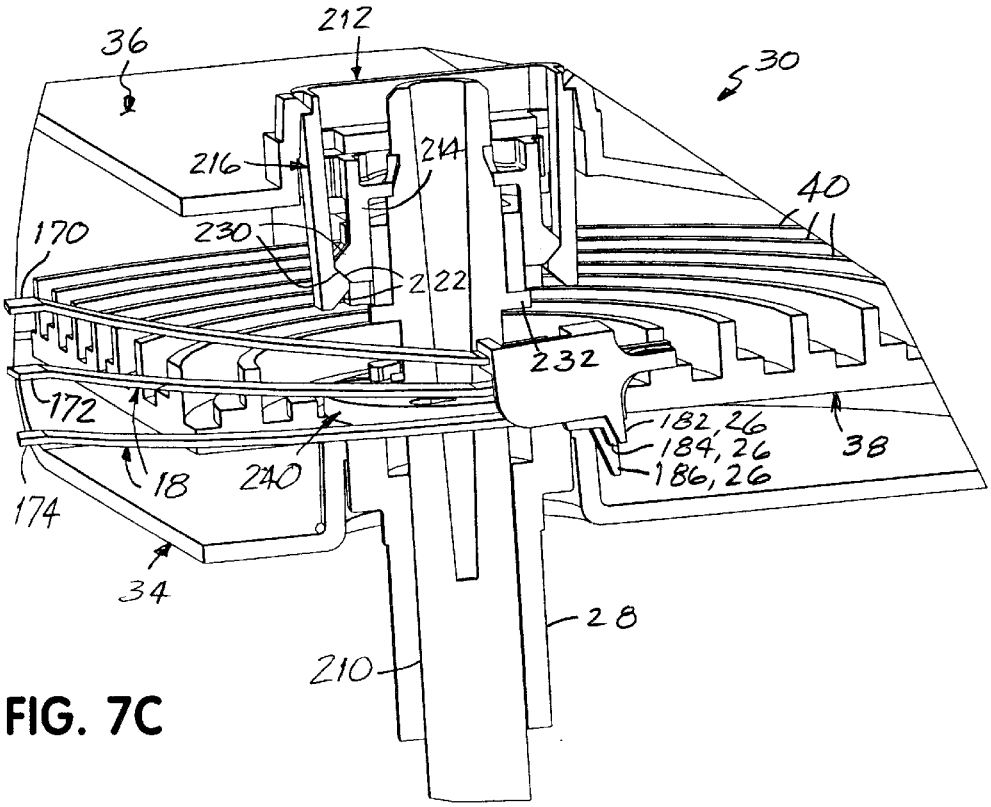

Referring now to FIG. 7C, the SF actuator 208, shaft 210 and latch 212 as shown in FIG. 7B have been sectioned in half to show ramp details of the key 214 and latch 212. These key ramps 230 operate to disengage the SF actuator 208 from a setting mode as follows: As the shaft 210 and attached key 214 are extended in a direction along the longitudinal axis of the shaft 210 and away from the rear housing 36 of the timer 10, the key ramp 230 applies force on the latch ramp 222 to force the latch fingers 218 away from the shaft 210. The arms 216 of the latch 212 are substantially parallel to the shaft 210 and have limited movement in a direction substantially perpendicular to the shaft 210 when a force is applied. As the key ramp 230 applies an outwardly directed force on the arms 216 of the latch 212 upon movement of the key 214, the latch fingers 218 will move away from the shaft 210. As the latch fingers 218 move away from the shaft 210, the flat sections 220 of the latch fingers 218 and the flat section 216 of the SF actuator 208 latching tabs 224 (shown in FIG. 7B) will become disengaged. At the point of disengagement, force from the switch arms 18 will cause the SF actuator 208 to move toward the main cam 38, allowing the switch arm cam followers 26 to contact the program cam surface 40. As the operator continues to extend the shaft 210 away from the rear housing 36 of the timer 10, the key ramps 230 and latch ramps 222 will help to force the shaft 210 to a fully extended position.

Figure 7D:
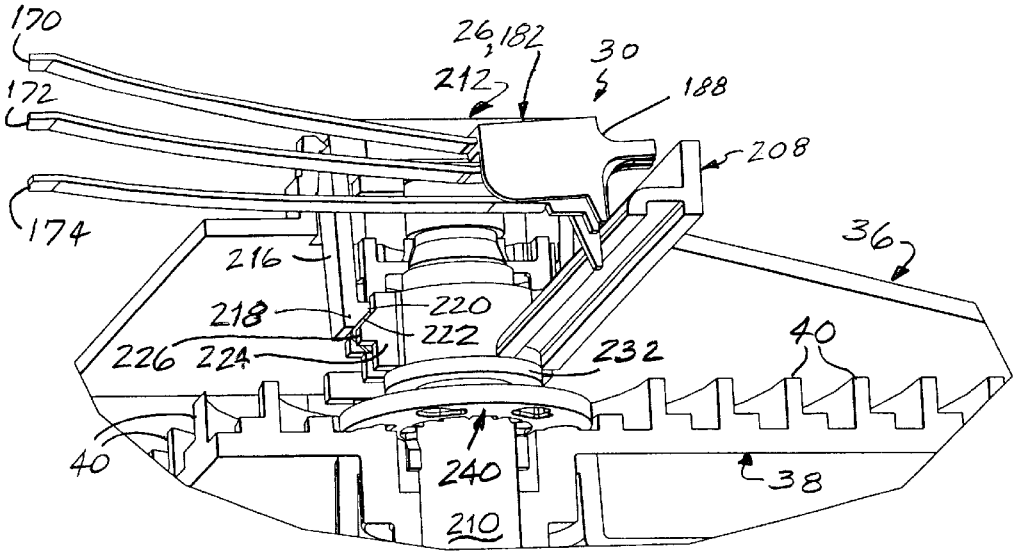
Figure 7E:
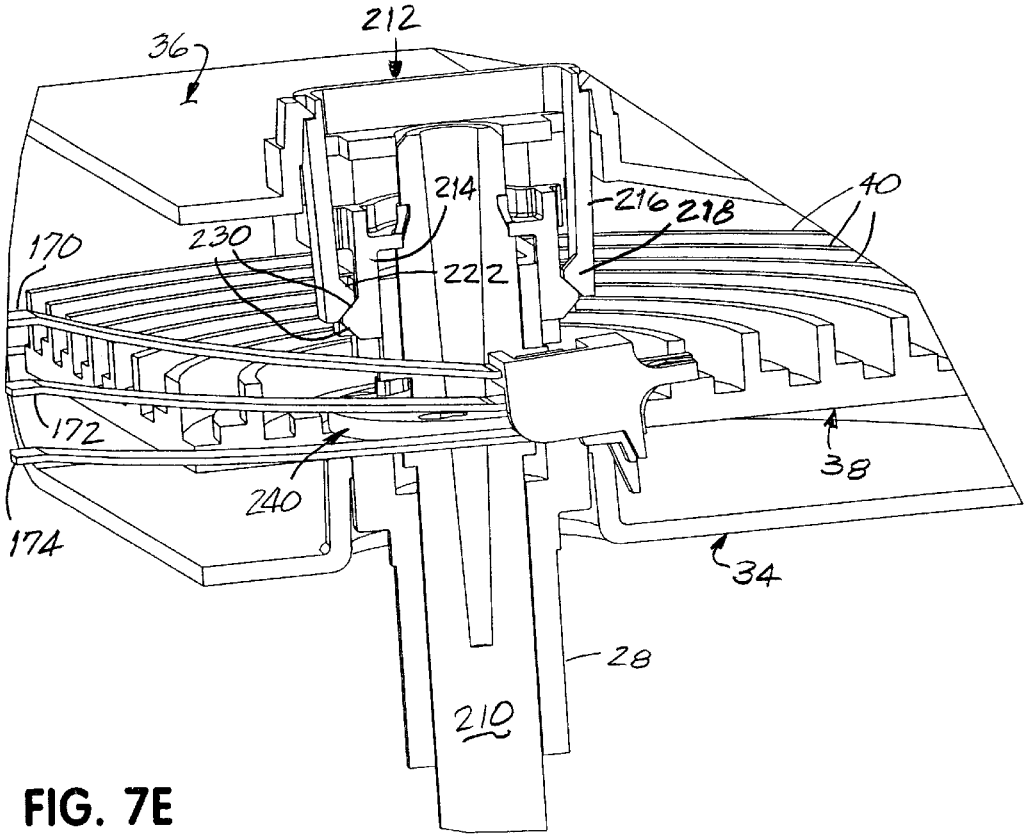

FIGS. 7D and 7E show the SF actuator 208, shaft 210 and attached key 214 in the fully extended position away from the rear housing 36 of the timer 10. The switch arms 18 are still shown in a lifted position in FIGS. 7D and 7E to demonstrate the distance the SF actuator 208 moves from the setting position once released from the latch 212. FIG. 7E depicts the SF actuator 208, shaft 210 and latch 212 of FIG. 7D sectioned in half to show the ramp details of the key 214 and latch 212 in the setting position. As the shaft 210 is indexed toward the rear housing 36 of the timer 10, a flange 232 disposed about and integral with the circumference of and integral with the shaft 210 engages the SF actuator 208 to lift the actuator 208 away from the cam 38, thereby operatively lifting the cam followers 26 away from the program surfaces 40 of main cam 38. The ramped surfaces 222, 220 of the latch tabs 224 and the key 214 force the latch fingers 218 away from the shaft 210 as previously described until the latch tabs 224 of the SF actuator 208 slide past the flat sections 220 of the latch fingers 218. Once the latch tabs 224 of the SF actuator 208 have moved from the side of the latch fingers 218 proximal to the front housing 34 of the timer 10 to a position on the side of the latch fingers 218 distal to the front housing 34 of the timer 10, the latch fingers 218 will "snap" back toward the shaft 210, locking the SF actuator 208 in the setting position (as in FIG. 7B).

Figure 7F:
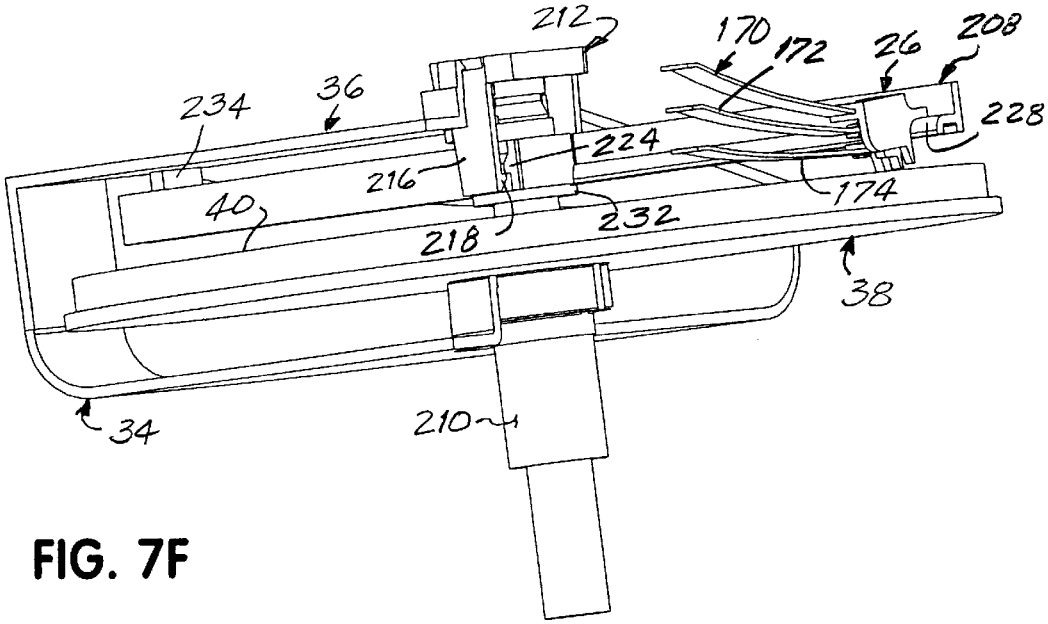

Referring now to FIG. 7F, it is shown that the SF actuator 208 spans across the full diameter of the main cam 38 and is parallel to the cam 38. As the SF actuator 208 is raised all the switch arms 18 to be lifted are on one side of the main cam 38. Thus, since the force of the switch arms 18, as they engage the SF actuator 208, is localized on one side of the shaft 210, a travel limiting boss 234 is disposed on the inside of the rear housing 36 over the SF actuator 208 and opposite the switch arms 18 of the timer 10. As the SF actuator 208 is raised, the travel limiting boss 234 forces the SF actuator 208 to level as the shaft 210 is being indexed toward the rear housing 36 of the timer 10. Specifically, as the shaft 210 is being indexed in, force from the switch arms 18 applied to the SF actuator 208 will tend to hold down the side of the SF actuator 208 engaging the switch arms 18. This results in the raising of the opposite side of the SF actuator 208, such that the actuator 208 is no longer parallel to the main cam 38. Once the side of the SF actuator 208 not engaging the switch arms 18 contacts the boss 234 on the rear housing 36, that side of the SF actuator 208 is prevented from moving and the side of the actuator 208 engaging the switch arms 18 will lift the switch arms 18. The boss 234 is designed so that when the SF actuator 208 is latched in place, it is parallel to the surface of the main cam 38.

Another aspect of the SF system 30 of the timer 10 of the present invention, shown in FIGS. 2D and 2E and previously discussed is the clutch mechanism 16, which is part of the geartrain 14 between the timing motor 12 and main cam 38. This clutch mechanism 16 provides a one-way coupling between the timing motor 12 and the main cam 38.

Specifically, the fifth stage pinion 94 in the geartrain 14, meshes with the outer gear ring 117 of the main cam 38, and is engaged to the fifth stage gear 92 in the geartrain 14 via the clutch mechanism 16. This clutch 16, as described above, permits manual forward rotation of the main cam 38, by allowing the main cam 38 and fifth stage pinion 94 of the drive train to rotate in a forward direction without rotating the remainder of the geartrain 14 or the timing motor 12. However, the clutch 16 prevents manual reverse rotation of the timer 10. During attempted reverse rotation of the cam 38, the fifth stage pinion 94 is coupled to the timing motor 12, which due to friction and the gear ratio of the geartrain 14, blocks rotation of the main cam 38.

Inward motion of the control shaft 210, however, forces the clutch 16 to a position in which the clutch 16 permits slip between the geartrain and the main cam 38, so that the main cam 38 and fifth stage pinion 94 of the geartrain 14 can be manually rotated forward and rearward uncoupled from the timing motor 12. Such inward motion of the control shaft results in a clutch lever (not shown), hinged in the front housing 34 of the timer 10, to be opened by the SF system 30, thereby permitting slip. However, the fifth stage pinion 94 of the geartrain 14 remains engaged to the gear ring 117 on the main cam 38, and rotates with the main cam 38, regardless of the position of the clutch 16. In this manner, manual reverse rotation of the main cam 38 is prevented as the geartrain 14 remains engaged. However, when the operator of the timer 10 indexes the shaft 210, the switch arms 18 are lifted out of contact with the program cam surfaces 40 and the geartrain 14 may slip in either direction, thereby allowing rotation of the main cam 38 in a forward or reverse direction.

Figure 7G:
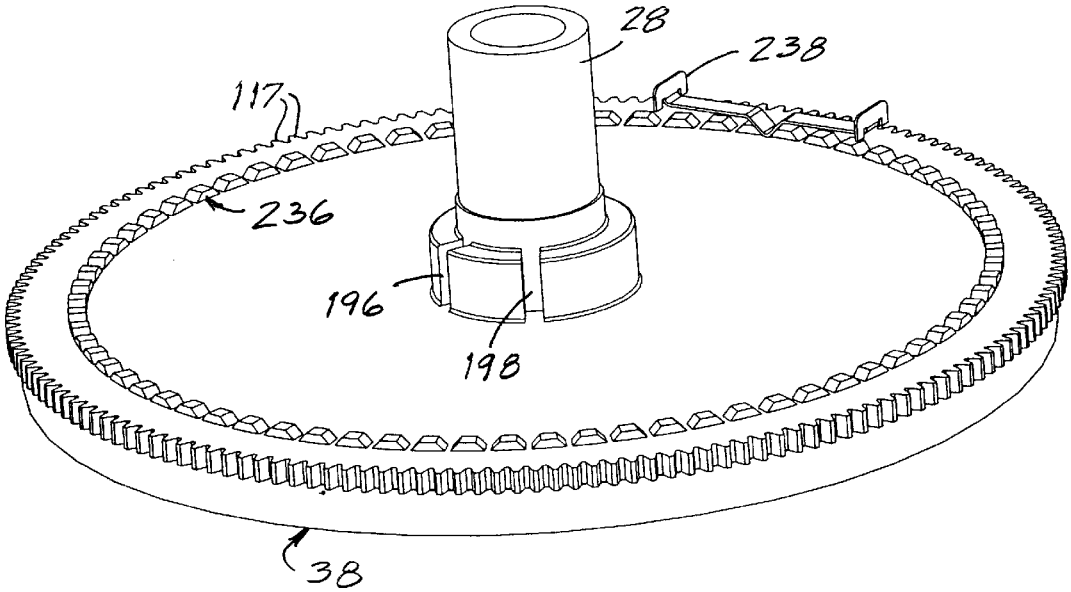
FIG. 7G is a perspective view of the main cam of the timer of the present invention, depicting the custom feel profile of the cam with a "V"-shaped follower providing tactile and/or audible feedback.

Referring now to FIG. 7G, upon lifting all cam followers 26 off the program cam surfaces 40 of the main cam 38, the main cam 38 can be rotated without restriction in either direction. A custom feel profile 236, similar to a program cam surface 40, is molded on the side of the main cam 38 proximal to the front housing 34 of the timer 10. This custom feel profile 236 includes a textured surface comprising a plurality of teeth or ridges used to impart tactile and/or audible feedback to the operator of the timer 10. The contours of these teeth may vary dependent upon appliance model, line, or the particular application or cycle for which the appliance is to be set. A "V"-shaped follower 238 is located in the front housing 34 of the timer 10 above and in engagement with the textured surface of the custom feel profile 236. As the user rotates the main cam 38, the "V"-shaped follower 238 engages the geometry of the teeth of the custom feel profile 236 thereby providing a tactile and/or audible feedback to the user. Since the restrictions of the geartrain 14 and the switch arm cam followers 26 are removed from the main cam 38, the textured surface of the custom feel profile 236 can be highly defined for each individual application. Since there is no drag on the main cam 38 from either the cam followers 26 or the geartrain 14, the total feel experienced by the operator of the timer 10 results from the tactile and/or audible feedback imparted by the "V"-shaped follower 238 riding on the custom feel profile 236 molded onto the main cam 38. The disengagement of the cam followers 26 and the slip of the geartrain 14 relative to the main cam 38 also allows the main cam 38 to be rotated in a reverse direction, making it easier to set. After the main cam 38 has been set to the desired position, the shaft 210 is extended in a direction away from the rear housing 36 of the timer 10.

As described above, in the illustrated embodiment, the timer 10 of the present invention includes a shaft 210 about which the cam-carrying member 38 rotates. A control knob (not shown) may be operatively connected to or near one end of the shaft 210. In one particular embodiment, the knob may be operatively connected to the end of the shaft 210 which is situated distally from the timer housing 34, and extends through to the exterior of the appliance (not shown) to which the timer 10 is operatively connected. Examples of such an appliance include, but are not limited to, a clotheswasher and/or a dryer. The knob is used by an operator to rotate the shaft 210 to a desired setting of the timer 10. The knob can either be indexed in or indexed out in order to cooperatively index the shaft 210 in and out to place the timer 10 in various modes, examples of which include, but are not limited to, a setting mode, a run mode, and a disengaged mode. In the particular embodiment of the timer 10 described above, when the shaft 210 is indexed "in", in a direction along the longitudinal axis of the shaft 210 and toward the rear housing 34 of the timer 10, the timer 10 is placed in a setting mode. However, it will be appreciated that alternate embodiments of the timer 10 may be configured such that the timer 10 is placed in a setting mode by indexing the shaft 210 "out", in a direction along the longitudinal axis of the shaft 210 and toward the front housing 36 of the timer 10.

In its operation, the illustrated embodiment of the timer of the present invention may be provided on both a first and second appliance, and is operated as follows. Initially, the knob is rotationally in an "off" position. This may be denoted by an indicia mark (not shown) on the knob and a corresponding indicia mark (not shown) on the appliance which, when aligned, place the cam-carrying member 38 in a position such that no function encoded by the cam-carrying member 38 is set to run. In the "off" position the shaft 210 is axially in a neutral first position. In order to place the timer 10 in a setting mode, the knob, and thus the shaft 210, may be indexed inwardly. In doing so, the knob and shaft 210 travel cooperatively axially from the first neutral position to a second position. This second position is located at a point disposed along the longitudinal axis of the shaft 210 in a direction toward the rear housing 34 of the timer 10. As a result, the shaft 210 is placed in engagement with the cam-carrying member 38 of the timer 10 such that the cam-carrying member 38 may be rotated cooperatively with the knob and shaft 210 to select a cycle on the timer 10 encoding a desired function of the appliance.

After a particular function of the appliance has been selected, the knob is indexed outwardly to return to the first neutral position. In a first embodiment of the timer 10, this causes the selected function of the first appliance to start. Without interruption, the first appliance will then run automatically until the end of the cycle on the cam-carrying member 38 encoding the specified function which has been selected. At that time, the shaft 210 and knob will have rotated cooperatively with the cam-carrying member 38 and at the end of the cycle the indicia mark indicator on the knob will again have aligned with the indicia mark on the first appliance in the "off" position. This indicates that the cam-carrying member 38 has also rotated completely through the cycle which had been set by the user.

Other components of the appliance may include switches (not shown) that are in series with the line supplying power to the timer. These components may act as a line switch to allow for interruption of the power, and thus, the operation of the appliance. In one example of such a component, the lid of a washer, dryer, or other appliance may include a lid switch in series with the line. Thus, if the lid of the appliance is opened during the cycle, the line switch will cause a break in the electrical circuit which causes the washer, dryer, or other appliance, to stop the currently operating function. If the operation of the appliance stops, it may restart once the electrical connection circuit is again completed, such as when the lid of the clotheswasher is closed.

Alternatively, at any point during the cycle of a selected function, the appliance may be manually stopped by indexing the knob, and thus the shaft 210, to the second position. The timer 10 and appliance function may then be restarted by re-indexing the knob and shaft 210 back to the first position. If so desired, the knob may alternatively be rotated to the "off" position to end the selected cycle.

Regarding the method of operating the timer 10, when the appliance on which the timer 10 of the present invention is used is a dryer, there exist alternate embodiments of the method of use. In a second embodiment, initially the knob is rotationally in the "off" position. In the "off" position the shaft 210 is axially in a neutral first position. In order to place the timer 10 in a setting mode, the knob, and thus the shaft 210, may be indexed inwardly. In doing so, the knob and shaft 210 travel cooperatively axially from the first position to a second position. As a result, the shaft 210 is placed in engagement with the cam-carrying member 38 of the timer 10 such that the cam-carrying member 38 may be rotated to select a cycle on the timer 10 encoding a desired function of the appliance.

After a particular function of the appliance has been selected, the knob is indexed outwardly to return to the first position. At this point the cam-carrying member 38 is engaged by the shaft 210 and is positioned to begin operation of the dryer. However, in the second embodiment, the dryer will not start until a separate start switch, operatively connected to the dryer, is actuated for a short time in order to override a centrifugal switch in the dryer and start the dryer. Once the start switch has been activated, the dryer then runs automatically until the end of the cycle.

As described above with respect to the first embodiment of the timer 10, the power to the appliance may be interrupted. For example, if the dryer door is opened during the cycle, the drum will stop rotating due to a break caused by a door switch operating as a line switch in series with the line. To restart the dryer in this second embodiment the user must close the door and then actuate the start switch for a short time in order to override the centrifugal switch of the dryer. To manually shut off the dryer the knob once again may be pushed in to the second position. If so desired the user may then rotate the knob to the "off" position.

In a third embodiment of the present invention initially, the knob is rotationally in the "off" position. In the "off" position the shaft 210 is axially in the neutral first position. In order to place the timer 10 in a setting mode, the knob, and thus the shaft 210, may be indexed inwardly. In doing so, the knob and shaft 210 travel cooperatively axially from the first position to a second position. As a result, the shaft 210 is placed in engagement with the cam-carrying member 38 of the timer 10 such that the cam-carrying member 38 may be rotated to select a cycle on the timer 10 encoding a desired function of the appliance.

After a particular function of the appliance has been selected, the knob is indexed outwardly to return to the first position. At this point the cam-carrying member 38 is engaged by the shaft 210 and is positioned to begin operation of the dryer. However, this third embodiment of the present invention uses a pull to start feature in order to start the dryer. To use this function, the knob is pulled axially past the original first position to a third position at a point along the longitudinal axis of the shaft 210 and distal from the front of the timer housing 36 and the first position. The knob is held there for a short time in order to override the centrifugal switch in the dryer and start the dryer. When released the knob and shaft 210 are spring loaded to return automatically to original axially first neutral position. The dryer of the third embodiment runs automatically unless the electrical circuits are interrupted as described above with respect to the second embodiment of the dryer timer.

In yet other alternate embodiments of the timer 10 of the present invention, axial operation of the knob and shaft 210 in an opposite direction than that described above is possible. For example, in one alternate embodiment of the timer 10 to be used on a washer or dryer in the present invention, the knob is rotationally in the "off" position and in a first neutral position axially. The user then indexes the knob and shaft 210 outwardly, causing the knob to travel axially from the first position to a second position along the longitudinal axis of the shaft 210 and in a direction away from the rear housing 34 of the timer 10. By indexing the shaft 210 outwardly, the shaft 210 engages the cam-carrying member 38 of the timer of the present invention. The user then rotates the knob in order to select a cycle encoding a desired appliance function. The knob is then indexed back into original axial first position. At this point the washer or dryer may start. The electrical power to the appliance may be interrupted as described previously.

Also as described previously the timer 10 in the dryer may include additional alternate embodiments. A fourth embodiment has the features of the third embodiment, but also includes a separate start switch that needs to be actuated for a short time in order to override the centrifugal switch in the dryer once the knob has been re-indexed in to the first position. In a fifth embodiment, a push-to-start feature is used. Once the knob has been indexed to its original first position from the second position, it is indexed inwardly further to a third position. The knob and shaft 210 are then held in the third position for a short time in order to override the centrifugal switch in the dryer. When released, the shaft 210 is spring loaded to return the shaft 210 and the knob automatically to the original first position.

While the present invention has been illustrated by the description of various embodiments thereof, and while these embodiments have been described in considerable detail, it is not the intention of the Applicant to restrict or in any way limit the scope of the appended claims to such detail. Additional advantages and modifications will readily appear to those skilled in the art. The invention in its broader aspects is therefore not limited to the specific details, representative system and method, and illustrative example shown and described. Accordingly, departures may be made from such details without departing from the spirit or scope of Applicant's general inventive concept.

What is claimed is:

1. A timer for controlling an appliance, comprising:

a rotatable cam-carrying member having cam surfaces thereon, a timing motor having a rotor that rotates in response to electrical stimulation, a drive mechanism for causing rotation of said rotatable cam-carrying member in response to rotation of said rotor, a plurality of cam-actuated switches, each cam-actuated switch comprising first and second metal switch arms, a plurality of said metal switch arms being mounted in a first wafer and a plurality of said metal switch arms being mounted in a second wafer, and a first switch wafer mounting receiving said first and second wafers with said second wafer being stacked atop the first wafer, wherein at least one of said first and second wafers includes standard switch arms and switch arms of different widths and/or made of different metals.

2. The timer of claim 1 further comprising a third wafer having a plurality of said switch arms.

3. The timer of claim 1 wherein said switch arms of different widths or different metals have a carrying capacity greater than that of said standard switch arms.

4. The timer of claim 3 wherein said carrying capacity is in the range of 15 amps to 25 amps.

5. The timer of claim 3 wherein said carrying capacity is at least 20 amps.

6. The timer of claim 1 wherein each of said switch arms of the timer are connected to a dryer by means of a connector block.

7. The timer of claim 6 wherein said connector block comprises a plurality of individual connectors mounted in an insulating structure, wherein each connector is further operatively connected to at least one wire, said at least one wire being operatively connected to said dryer.

8. The timer of claim 1 further comprising a plurality of said switch arms being mounted in a third wafer and a plurality of said switch arms being mounted in a fourth wafer.

9. The timer of claim 8 further comprising a second switch wafer mounting receiving said third and fourth wafers with said fourth wafer being stacked atop said third wafer.

10. The timer of claim 9, wherein at least one of said third and fourth wafers includes standard switch arms and switch arms of different widths and/or made of different metals.

11. The timer of claim 9, wherein the rotatable cam carrying member has an axial centerline, and wherein said first and second wafers are located on a first side of said axial centerline and said third and fourth wafers are located on a s second side of said axial centerline.

12. The timer of claim 11, wherein said plurality of switch arms mounted in said first wafer and said plurality of switch arms mounted in said second wafer overlie said rotatable cam-carrying member on said first side of said axial centerline, and wherein said plurality of switch arms mounted in said third wafer and said plurality of switch arms mounted in said fourth wafer overlie said rotatable cam-carrying member on said second side of said axial centerline.

13. The timer of claim 9, wherein the rotatable cam-carrying member has an axial centerline, and wherein said first and second wafers and said third and fourth wafers are each located on a first side of said axial centerline.

14. The timer of claim 13, wherein said plurality of switch arms mounted in said first wafer and said plurality of switch arms mounted in said second wafer overlie said rotatable cam-carrying member on said first side of said axial centerline, and wherein said plurality of switch arms mounted in said third wafer and said plurality of switch arms mounted in said fourth wafer overlie said rotatable cam-carrying member on said first side of said axial centerline.

15. The timer of claim 9, further comprising a plurality of connector blocks, each of said connector blocks being operatively connected to at least two of said switch arms.

16. The timer of claim 9, further comprising a first connector block and a second connector block, wherein said switch arms in said first wafer and said second wafer are connected to said first connector block, and wherein said switch arms in said third wafer and said fourth wafer are connected to said second connector block.

* * * * *

UNITED STATES PATENT AND TRADEMARK OFFICE

CERTIFICATE OF CORRECTION

PATENT NO. : 6,613,991 B1 
DATED : September 2, 2003
INVENTOR(S) : Amonett et al.

It is certified that error appears in the above-identified patent and that said Letters Patent is hereby corrected as shown below:

Column 1,
Line 51, "to make or break and electrical contact" should be -- to make or break an electrical contact --.

Column 2,
Lines 15-17, "arms of each switch is mounted … and … arms of each switch is mounted in a second wafer" should be -- arms of each switch are mounted … and … arms of each switch are mounted in a second wafer --.
Line 66, "drum is an appropriate initial position to" should be -- drum is in an appropriate initial position to --.

Column 3,
Line 30, "from the surface the drum to" should be -- from the surface of the drum to --.
Line 43, "timers, timer fuctions, and methods for … varies from appliance to appliance" should be -- timers, timer functions and methods for … vary from appliance to appliance --.

Column 3, line 67 to Column 4, line 2,
"In the washer a knob attached to a shaft in the timer which is indexed inwardly in order for the shaft to engage a cam-carrying member." should be -- In the washer a knob is attached to a shaft in the timer which is indexed inwardly in order for the shaft to engage a cam-carrying member. --.

Column 6,
Line 66, "the second switch waver to…" should be -- the second switch wafer to … --.

Column 11,
Line 26, "and staked in place" should be -- and stacked in place --.

Column 12,
Line 9, "counter-clockwise" should be -- counterclockwise --.

Column 13,
Lines 5, 12 and 24, "counter-clockwise" should be -- counterclockwise --.

Column 15,
Line 9, "0.125 inches wide by 0.0020 inches thick" should be -- 0.125 inch wide by 0.020 inch think --.
Line 42, "differing switch arms materials and/or" should be -- differing switch arm materials and/or --.

UNITED STATES PATENT AND TRADEMARK OFFICE

CERTIFICATE OF CORRECTION

PATENT NO. : 6,613,991 B1
DATED : September 2, 2003
INVENTOR(S) : Amonett et al.

It is certified that error appears in the above-identified patent and that said Letters Patent is hereby corrected as shown below:

Column 17,
Line 39, "have a length of 0.600 inches in the" should be -- have a length of 0.600 inch in the --.
Line 44, "Each wafer 20 is 0.200 inches thick" should be -- Each wafer 20 is 0.200 inch thick --.
Line 46, "the post 128 is reduced by 0.010 inches." should be -- the post 128 is reduced by 0.010 inch. --.
Lines 48 and 51, "0.010 inches smaller in diameter" should be -- 0.010 inch smaller in diameter --.
Line 67, "the wafer arm of the lower wafer is 0.020 inches" should be -- the wafer arm of the lower wafer is 0.020 inch --.

Column 18,
Line 3, "0.020 inches longer than the wafer arm" should be -- 0.020 inch longer than the wafer arm --.
Line 23, "embodiment of the present inception" should be -- embodiment of the present invention --.

Column 20,
Line 13, "and potential reduce the number of" should be -- and potentially reduce the number of --.

Column 27,
Line 59, "intention of the Applicant to" should be -- intention of the Applicants to --.
Line 67, "from the spirit or scope of Applicant's general inventive concept" should be -- from the spirit or scope of Applicants' general inventive concept --.

UNITED STATES PATENT AND TRADEMARK OFFICE

CERTIFICATE OF CORRECTION

PATENT NO. : 6,613,991 B1 
DATED : September 2, 2003
INVENTOR(S) : Amonett et al.

It is certified that error appears in the above-identified patent and that said Letters Patent is hereby corrected as shown below:

Column 28,
Line 31, "each of said … are connected to" should be -- each of said … is connected to --.

Signed and Sealed this

Twenty-third Day of March, 2004

JON W. DUDAS
*Acting Director of the United States Patent and Trademark Office*